US009753397B2

(12) United States Patent
Kosasa

(10) Patent No.: US 9,753,397 B2
(45) Date of Patent: Sep. 5, 2017

(54) IMAGE FORMING APPARATUS AND IMAGE DISPLACEMENT CORRECTION METHOD

(71) Applicant: Oki Data Corporation, Tokyo (JP)

(72) Inventor: Tsutomu Kosasa, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 15/269,394

(22) Filed: Sep. 19, 2016

(65) Prior Publication Data

US 2017/0090337 A1 Mar. 30, 2017

(30) Foreign Application Priority Data

Sep. 30, 2015 (JP) ..... 2015-192653

(51) Int. Cl.
*G03G 15/043* (2006.01)

(52) U.S. Cl.
CPC ..... *G03G 15/043* (2013.01)

(58) Field of Classification Search
CPC ..... G03G 15/04; G03G 15/043; G03G 15/04054; G03G 15/5033
See application file for complete search history.

(56) References Cited

U.S. PATENT DOCUMENTS

| | | | | |
|---|---|---|---|---|
| 6,160,610 | A | 12/2000 | Toda | |
| 2010/0080594 | A1* | 4/2010 | Sowa | G03G 15/043 399/51 |
| 2014/0321889 | A1* | 10/2014 | Kosasa | G03G 15/0131 399/301 |
| 2015/0212449 | A1 | 7/2015 | Yokoi | |

FOREIGN PATENT DOCUMENTS

| | | | |
|---|---|---|---|
| EP | 2549334 | A1 | 1/2013 |
| JP | 2001-134041 | A | 5/2001 |
| JP | 2002-052757 | A | 2/2002 |
| JP | 2011-194684 | A | 10/2011 |

* cited by examiner

*Primary Examiner* — Hoang Ngo
(74) *Attorney, Agent, or Firm* — Rabin & Berdo, P.C.

(57) ABSTRACT

An image forming apparatus includes: a first optical head group including first optical heads arranged in a sub-scanning direction; a second optical head group including second optical heads arranged in the sub-scanning direction and overlapping the first optical head group in a main scanning direction; a detector that detects displacement amounts between the first optical heads and the second optical heads; and a controller that performs registration based on the detection by the detector. The controller performs, with one of the first optical heads as a reference, registration on the other first optical heads, performs, with one of the second optical heads as a reference, registration on the other second optical heads, and performs registration between the first optical head group and the second optical head group based on a displacement amount between one of the first optical heads and one of the second optical heads.

15 Claims, 15 Drawing Sheets

No. +2
+1
0
−1
−2
d −2β
d −β
d +β
d +2β
c
d
e
Sp
Rh1
Rh2
D1
D2

IMAGE FORMING APPARATUS AND IMAGE DISPLACEMENT CORRECTION METHOD

BACKGROUND OF THE INVENTION

1. Field of the Invention

The present invention relates to an image forming apparatus including multiple optical heads and an image displacement correction method therefor.

2. Description of the Related Art

Japanese Patent Application Publication No. 2011-194684 discloses an electrophotographic image forming apparatus including first and second print heads arranged so that their end portions overlap each other in a main scanning direction, and being capable of printing an image on a wide recording medium. This image forming apparatus calculates a displacement amount between the first and second print heads based on density of a pattern image formed on a photosensitive drum and predetermined reference density data, and corrects displacement between the first and second print heads based on the calculated displacement amount.

Japanese Patent Application Publication No. 2001-134041 discloses an electrophotographic image forming apparatus including multiple printing units along a conveyance path for a recording medium, and being capable of color printing. This image forming apparatus detects color displacement amounts in a conveyance direction of the recording medium from detection pattern images printed by the multiple printing units, and corrects printing positions of the printing units in the conveyance direction of the recording medium based on the detected color displacement amounts.

It is desirable that image displacement be corrected in a short time.

SUMMARY OF THE INVENTION

An aspect of the present invention is intended to provide an image forming apparatus and an image displacement correction method capable of correcting image displacement in a short time.

According to an aspect of the present invention, there is provided an image forming apparatus including: a first optical head group and a second optical head group that form electrostatic latent images on at least one image carrier, the first optical head group including a plurality of first optical heads arranged in a sub-scanning direction, the second optical head group including a plurality of second optical heads arranged in the sub-scanning direction, the first optical head group and the second optical head group overlapping each other in a main scanning direction; a detector that is disposed to correspond to a region where the first optical head group and the second optical head group overlap each other and that detects displacement amounts between the first optical heads and the second optical heads; and a controller that performs registration by controlling light emission of the plurality of first optical heads and the plurality of second optical heads based on the detection by the detector, wherein the controller performs, with one of the first optical heads in the first optical head group as a reference, registration on the other first optical heads in the first optical head group based on the detection by the detector, performs, with one of the second optical heads in the second optical head group as a reference, registration on the other second optical heads in the second optical head group based on the detection by the detector, and performs registration between the first optical head group and the second optical head group based on a displacement amount between one of the first optical heads in the first optical head group and one of the second optical heads in the second optical head group.

According to another aspect of the present invention, there is provided an image forming apparatus including:

a first optical head unit and a second optical head unit that form electrostatic latent images on at least one image carrier, the first optical head unit including a plurality of optical heads arranged in a main scanning direction to overlap each other in the main scanning direction, the second optical head unit including a plurality of optical heads arranged in the main scanning direction to overlap each other in the main scanning direction; a detector that is disposed to correspond to a region where the optical heads overlap each other and that detects a displacement amount of each of the optical heads; and a controller that performs registration by controlling light emission of the optical heads based on the detection by the detector, wherein, in the registration, the controller performs, with one of the plurality of optical heads in the first optical head unit as a reference, registration on the other optical heads in the first optical head unit based on the detection by the detector, performs, with one of the plurality of optical heads in the second optical head unit as a reference, registration on the other optical heads in the second optical head unit based on the detection by the detector, and performs registration between the first optical head unit and the second optical head unit based on a displacement amount between one of the plurality of optical heads in the first optical head unit and one of the plurality of optical heads in the second optical head unit.

DETAILED DESCRIPTION OF THE INVENTION

First Embodiment

<1-1> Configuration of First Embodiment

Figure 1:
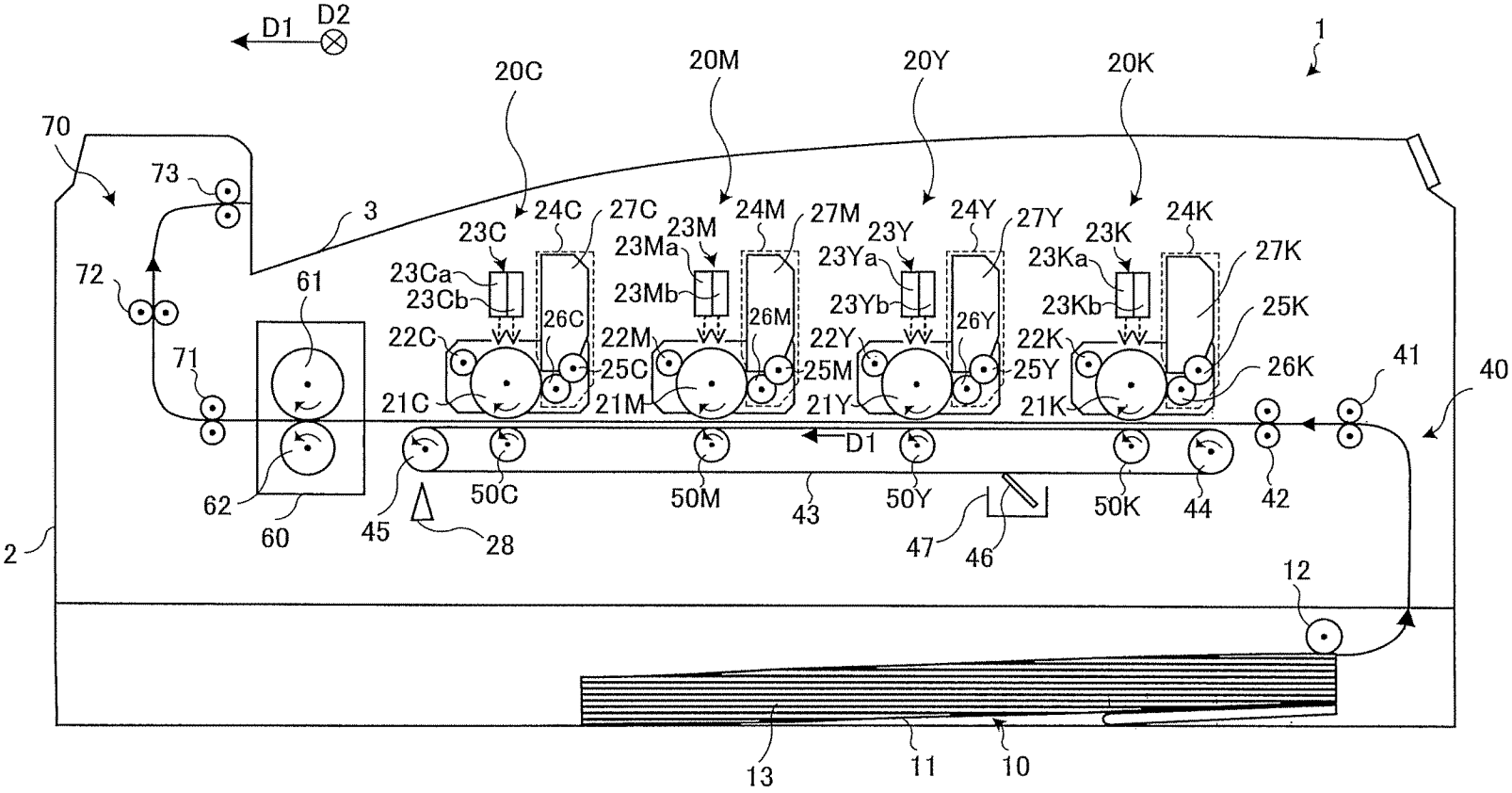
FIG. 1 is a vertical cross-sectional view of an image forming apparatus according to a first embodiment of the present invention.

FIG. 1 is a diagram schematically illustrating a configuration of an image forming apparatus 1 according to a first embodiment of the present invention. The image forming apparatus 1 is a device that can perform an image displacement correction method according to the first embodiment. For example, the image forming apparatus 1 is a color printer that employs an electrophotographic method.

As illustrated in FIG. 1, the image forming apparatus 1 includes multiple image forming units 20K, 20Y, 20M, and 20C that form developer images (toner images) on a recording medium 13, which may be a sheet such as a paper sheet, by the electrophotographic method, and a medium supply unit (paper feeder unit) 10 that supplies the recording medium 13 to the multiple image forming units 20K, 20Y, 20M, and 20C. The image forming apparatus 1 also includes a conveyance unit 40 that conveys the recording medium 13 supplied from the medium supply unit 10, transfer rollers (transfer devices) 50K, 50Y, 50M, and 50C that are disposed to correspond to the image forming units 20K, 20Y, 20M, and 20C and transfer toner images onto the recording medium 13 from the image forming units 20K, 20Y, 20M, and 20C, respectively, and a fixing device 60 that fixes on the recording medium 13 the toner images transferred onto the recording medium 13. The image forming apparatus 1 further includes a medium discharging unit (paper discharging unit) 70 that discharges the recording medium 13 that has passed through the fixing device 60 onto a stacker 3 outside a housing 2 of the image forming apparatus 1. FIG. 1 illustrates the four image forming units 20K, 20Y, 20M, and 20C, but the number of image forming units included in the image forming apparatus 1 may be 2, 3, 5 or more. Moreover, the image forming apparatus 1 illustrated in FIG. 1 is a printer, but the present invention is applicable to other image forming apparatus, such as a copier, a facsimile machine, or a multi-functional peripheral (MFP), including multiple image forming units.

The medium supply unit 10 includes a medium cassette (paper sheet cassette) 11 that stores recording media 13 and a paper feed roller (hopping roller) 12 that feeds one by one the recording media 13 stacked in the medium cassette 11. The medium cassette 11 is detachably installed in the housing 2 of the image forming apparatus 1. The recording media 13 stacked in the medium cassette 11 are picked up one by one by the paper feed roller 12, and the picked-up recording medium 13 is conveyed by pairs of conveyance rollers 41 and 42 of the conveyance unit 40 to pass through a medium conveyance path between the image forming units 20K, 20Y, 20M, and 20C and the transfer rollers 50K, 50Y, 50M, and 50C.

The conveyance unit 40 includes a conveyance belt 43 as an endless belt movably supported, a drive roller 45 that drives the conveyance belt 43, a tension roller (driven roller) 44 that stretches the conveyance belt 43 together with the drive roller 45, a cleaning blade 46 that cleans the conveyance belt 43 by scraping off toner remaining on the conveyance belt 43, and a waste toner tank 47 that stores the toner scraped off by the cleaning blade 46. The conveyance unit 40 also includes a mechanism that rotates the drive roller 45 The mechanism includes, for example, a driving force source (a drive roller driver 45*a* in FIG. 2 described later), such as a motor, and a driving force transmission mechanism, such as a gear mechanism, that transmits the driving force generated by the driving force source to the drive roller 45.

The image forming units 20K, 20Y, 20M, and 20C are arranged side by side (in tandem) along the medium conveyance path in a medium conveyance direction, i.e., a traveling direction (direction D1 in FIG. 1) of the conveyance belt 43 on the image forming unit side. The image forming units 20K, 20Y, 20M, and 20C have substantially the same structure except that they use toners of different colors. The image forming units 20K, 20Y, 20M, and 20C may be detachably attached to the housing 2.

When performing normal printing operation, the image forming units 20K, 20Y, 20M, and 20C respectively form a toner image of black (K), a toner image of yellow (Y), a toner image of magenta (M), and a toner image of cyan (C) on the recording medium 13 conveyed in the traveling direction D1.

In the first embodiment, when performing a process according to the image displacement correction method, the image forming units 20K, 20Y, 20M, and 20C respectively form a toner image of black (K), a toner image of yellow (Y), a toner image of magenta (M), and a toner image of cyan (C) on the conveyance belt 43 traveling in the traveling direction D1. The toner images of the respective colors formed on the conveyance belt 43 are detected by optical sensors (optical sensors 28*a*, 28*b*, and 28*c* in FIG. 3 described later) constituting a detector 28. The detector 28 is used to detect positions on the conveyance belt 43 of transferred developer images (transferred toner images) that are developer images transferred onto the conveyance belt 43 from the image forming units 20K, 20Y, 20M, and 20C. The optical sensor 28*b* is also used to detect positions of the transferred developer images (transferred toner images) in a main scanning direction (direction D2 perpendicular to the traveling direction D1 of the conveyance belt 43).

The image forming units 20K, 20Y, 20M, and 20C respectively include head units 23K, 23Y, 23M, and 23C, which are exposure devices for the respective colors. The head units 23K, 23Y, 23M, and 23C are attached to an inner surface (a lower surface in FIG. 1) of a top cover of the housing 2, for example. In the first embodiment, the head unit 23K includes two optical heads (a first optical head 23Ka and a second optical head 23Kb) that perform exposure based on black image data; the head unit 23Y includes two optical heads (a first optical head 23Ya and a second optical head 23Yb) that perform exposure based on yellow image data; the head unit 23M includes two optical heads (a first optical head 23Ma and a second optical head 23Mb) that perform exposure based on magenta image data; the head unit 23C includes two optical heads (a first optical head 23Ca and a second optical head 23Cb) that perform exposure based on cyan image data. The head unit 23K receives a driving signal based on black image data, and the optical heads 23Ka and 23Kb emit exposure light according to the received driving signal to a photosensitive drum 21K; the head unit 23Y receives a driving signal based on yellow image data, and the optical heads 23Ya and 23Yb emit exposure light according to the received driving signal to a photosensitive drum 21Y; the head unit 23M receives a driving signal based on magenta image data, and the optical heads 23Ma and 23Mb emit exposure light according to the received driving signal to a photosensitive drum 21M; the head unit 23C receives a driving signal based on cyan image data, and the optical heads 23Ca and 23Cb emit exposure light according to the received driving signal to a photosensitive drum 21C. Each of the optical heads 23Ka, 23Kb, 23Ya, 23Yb, 23Ma, 23Mb, 23Ca, and 23Cb is a light-emitting diode (LED) array head having multiple LEDs arrayed in the main scanning direction D2.

The image forming units 20K, 20Y, 20M, and 20C respectively include the photosensitive drums 21K, 21Y, 21M, and 21C as image carriers supported rotatably about their rotational axes, and charging rollers 22K, 22Y, 22M, and 22C as charging members that uniformly charge surfaces of the photosensitive drums 21K, 21Y, 21M, and 21C. The image forming units 20K, 20Y, 20M, and 20C also include developing units (developing devices) 24K, 24Y, 24M, and 24C that form toner images (developer images) corresponding to electrostatic latent images formed on the surfaces of the photosensitive drums 21K, 21Y, 21M, and 21C by exposure by means of the head units 23K, 23Y, 23M, and 23C by supplying the toner to the surfaces of the photosensitive drums 21K, 21Y, 21M, and 21C, respectively. The developing units 24K, 24Y, 24M, and 24C include developing rollers 26K, 26Y, 26M, and 26C as developer carriers, supply rollers 25K, 25Y, 25M, and 25C as supply members that supply toner onto the developing rollers 26K, 26Y, 26M, and 26C, and toner cartridges 27K, 27Y, 27M, and 27C as containers that contain toner, respectively.

The photosensitive drums 21K, 21Y, 21M, and 21C include a pipe-shaped (or cylindrical) conductive support made of metal, such as aluminum, and a photoconductive layer over a surface of the conductive support. The photosensitive drums 21K, 21Y, 21M, and 21C are rotated about their rotational axes in directions of arrows in FIG. 1 (clockwise in FIG. 1) by a driving force from a drive unit (for example, an image forming unit driver 21*a* in FIG. 2 described later), such as a motor.

The transfer rollers 50K, 50Y, 50M, and 50C are disposed opposite the photosensitive drums 21K, 21Y, 21M, and 21C of the image forming units 20K, 20Y, 20M, and 20C with the conveyance belt 43 therebetween. The transfer rollers 50K, 50Y, 50M, and 50C sequentially transfer the developer images (toner images) formed on the surfaces of the photosensitive drums 21K, 21Y, 21M, and 21C of the image forming units 20K, 20Y, 20M, and 20C, onto an upper surface of the recording medium 13 conveyed in the traveling direction D1 along the medium conveyance path or an upper surface of the conveyance belt 43, to form a color image in which the multiple toner images (transferred developer images) are superimposed.

As illustrated in FIG. 1, the fixing device 60 includes a pair of rollers 61 and 62 in pressure contact with each other. The roller 61 is a heat roller including a heater, and the roller 62 is a pressure roller pressed against the roller 61. When the recording medium 13 passes between the pair of rollers 61 and 62 of the fixing device 60, the developer images (toner images) on the recording medium 13, which have not been fixed, are heated and pressed to be fixed onto the recording medium 13.

The medium discharging unit 70 includes pairs of conveyance rollers 71, 72, and 73 each consisting of two rollers in pressure contact with each other. The rollers constituting the pairs of conveyance rollers 71, 72, and 73 are connected to a drive unit including a motor and a power transmission mechanism consisting of gears or the like for transmitting rotational driving force, and rotated to convey the recording medium 13. The configuration of the medium discharging unit 70 is not limited to the example of FIG. 1, and may further include other components, such as another pair of rollers and a sensor that detects passage of the recording medium 13.

The configuration of the image forming apparatus 1 is not limited to the example of FIG. 1. For example, the image forming apparatus 1 may include a medium reversing mechanism for reversing the recording medium 13 that has passed through the fixing device 60 and feeding the recording medium 13 to the image forming units 20K, 20Y, 20M, and 20C. Moreover, instead of the conveyance belt 43, the image forming apparatus 1 may include an intermediate transfer belt onto which toner images are transferred, and a secondary transfer roller for transferring onto the recording medium the toner images on the intermediate transfer belt.

Figure 2:
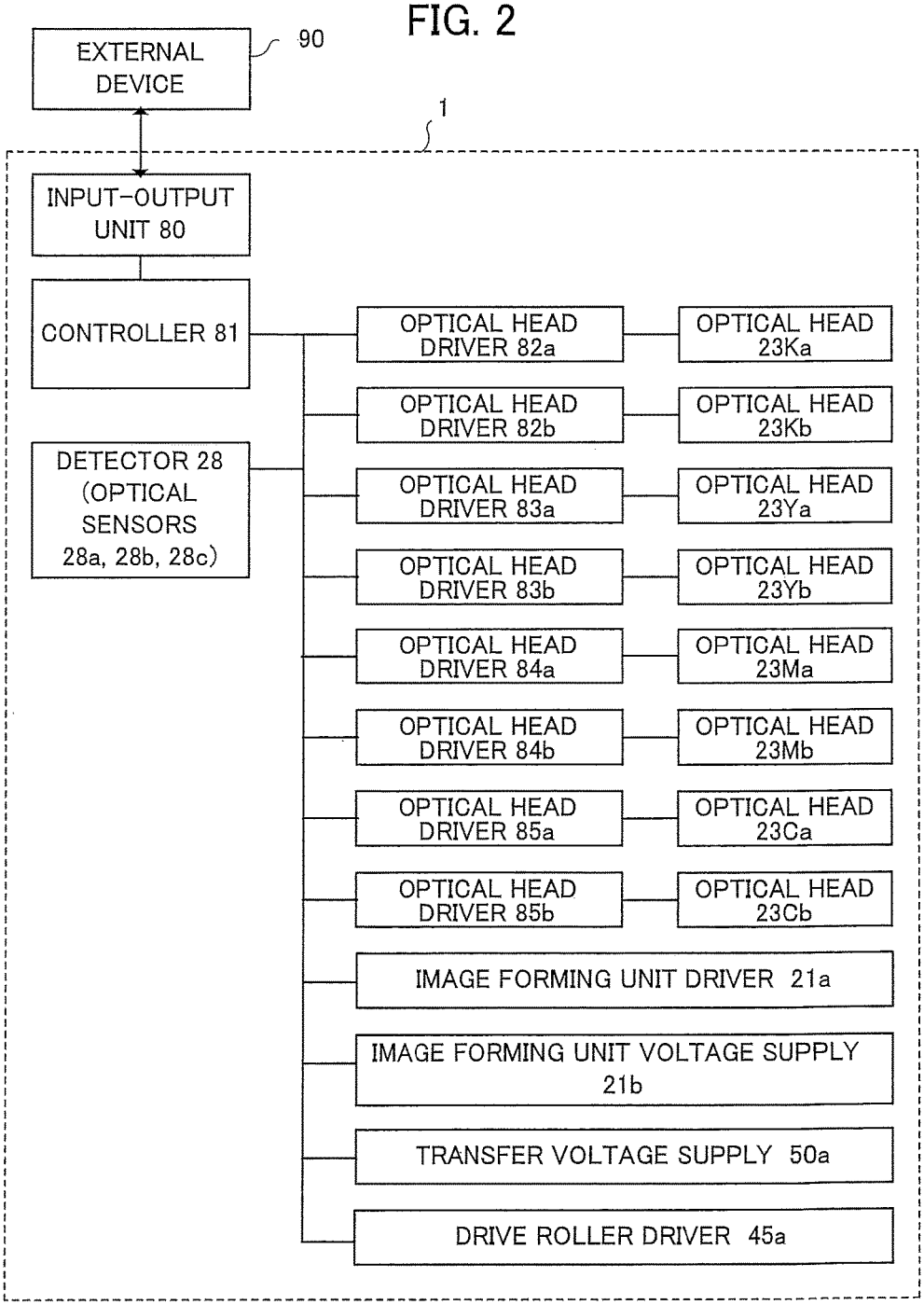
FIG. 2 is a block diagram schematically illustrating major components of a control system of the image forming apparatus according to the first embodiment.

FIG. 2 is a block diagram schematically illustrating major components of a control system of the image forming apparatus 1 according to the first embodiment. The image forming apparatus 1 includes, as major components, an input-output unit (interface unit) 80 that communicates with an external device 90, such as a host computer, and a controller 81 that controls the operation of the entire apparatus including the multiple image forming units 20K, 20Y, 20M, and 20C. The image forming apparatus 1 also includes optical head driver 82*a*, 82*b*, 83*a*, 83*b*, 84*a*, 84*b*, 85*a*, and 85*b* that drive (cause to emit light) the optical heads 23Ka, 23Kb, 23Ya, 23Yb, 23Ma, 23Mb, 23Ca, and 23Cb in accordance with driving signals from the controller 81; the image forming unit driver 21*a* that drives the photosensitive drums 21K, 21Y, 21M, and 21C and the like of the image forming units 20K, 20Y, 20M, and 20C; and the drive roller driver 45*a* that rotates the drive roller 45 to move the conveyance belt 43. The image forming apparatus 1 also includes an image forming unit voltage supply 21*b* that applies voltage to the photosensitive drums 21K, 21Y, 21M, and 21C, the charging rollers 22K, 22Y, 22M, and 22C, the developing rollers 26K, 26Y, 26M, and 26C, and the supply rollers 25K, 25Y, 25M, and 25C. The image forming apparatus 1 also includes a transfer voltage supply 50*a* that applies voltage to the transfer rollers 50K, 50Y, 50M, and 50C.

The controller 81 forms detection pattern images (transferred developer images) for the image displacement correction process on the conveyance belt 43, and performs control of light emission times of the optical heads 23Ka, 23Kb, 23Ya, 23Yb, 23Ma, 23Mb, 23Ca, and 23Cb based on the detection by the detector 28, and control of light emission positions in the main scanning direction of the optical heads 23Ka, 23Kb, 23Ya, 23Yb, 23Ma, 23Mb, 23Ca, and 23Cb in the head units 23K, 23Y, 23M, and 23C.

The image forming apparatus according to the first embodiment includes a first optical head group 23*a* and a second optical head group 23*b* that form electrostatic latent images on the photosensitive drums 21K, 21Y, 21M, and 21C as the image carriers. The first optical head group 23*a* includes the multiple first optical heads 23Ka, 23Ya, 23Ma, and 23Ca arranged in a sub-scanning direction. The second optical head group 23*b* includes the multiple second optical heads 23Kb, 23Yb, 23Mb, and 23Cb arranged in the sub-scanning direction. The first optical head group 23*a* and the second optical head group 23*b* are disposed to overlap each other in the main scanning direction. The image forming apparatus according to the first embodiment includes the detector 28 and controller 81. The detector 28 is disposed to correspond to a region where the first optical head group 23*a* and the second optical head group 23*b* overlap each other, and detects displacement amounts between the first optical heads and the second optical heads. The controller 81 performs registration (or position adjustment) by controlling light emission of the multiple first optical heads 23Ka, 23Ya, 23Ma, and 23Ca and the multiple second optical heads 23Kb, 23Yb, 23Mb, and 23Cb based on the detection by the detector 28. The controller 81 performs, with one of the first optical heads in the first optical head group 23*a* as a reference, registration on the other first optical heads in the first optical head group 23*a* based on the detection by the detector 28. The controller 81 performs, with one of the second optical heads in the second optical head group 23*b* as a reference, registration on the other second optical heads in the second optical head group 23*b* based on the detection by the detector 28. The controller 81 performs registration between the first optical head group 23*a* and the second optical head group 23*b* based on a displacement amount between one of the first optical heads in the first optical head group 23*a* and one of the second optical heads in the second optical head group 23*b*.

The controller 81 may be implemented using one or more circuits, such as hard-wired circuits or programmable processors. For example, the controller 81 includes a memory that stores instructions, and a processor that executes the instructions to perform the functions of the controller 81.

Figure 3:
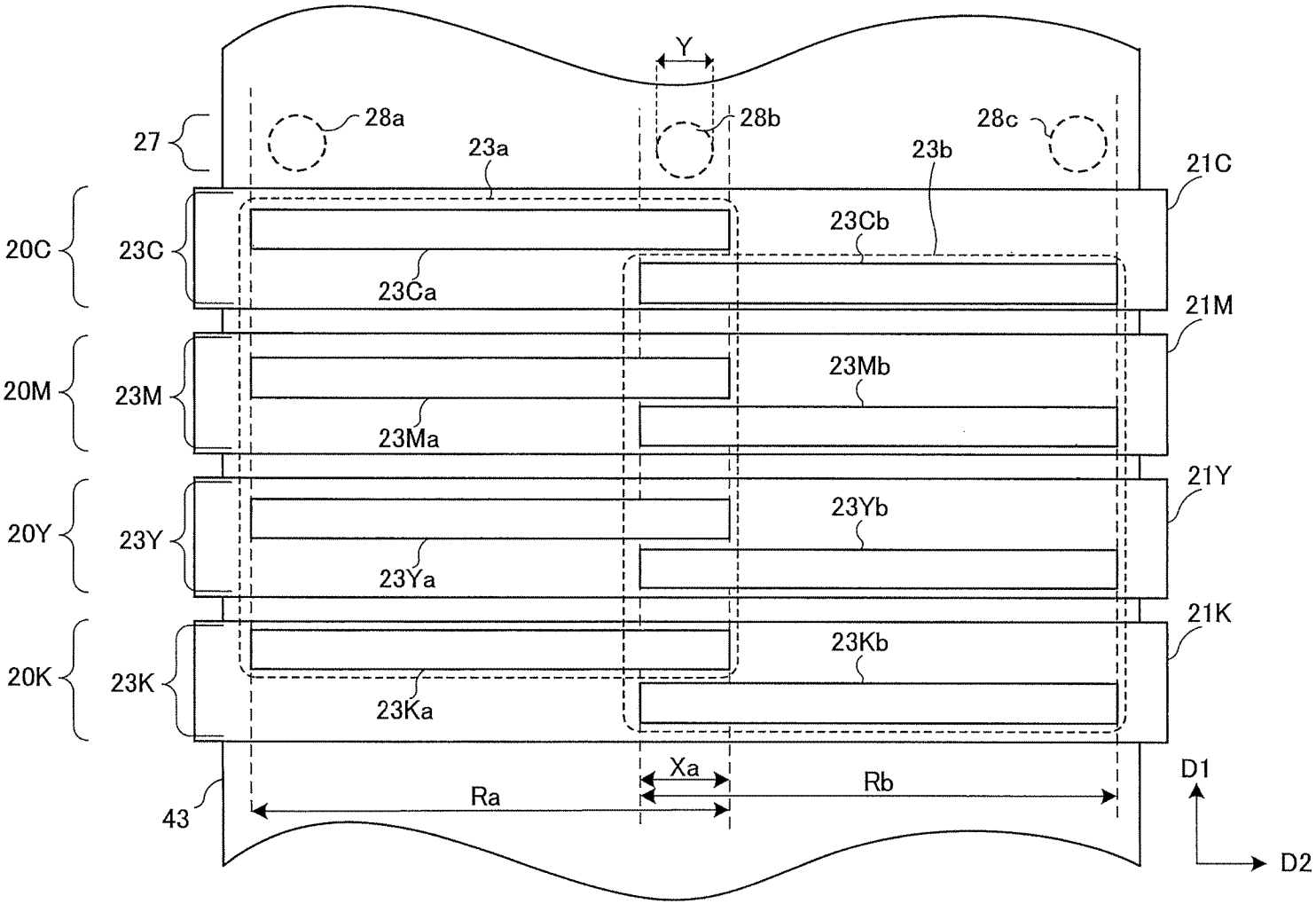
FIG. 3 is a plan view schematically illustrating an arrangement of multiple image forming units, a conveyance belt, and optical sensors in the image forming apparatus according to the first embodiment.

FIG. 3 is a plan view schematically illustrating an arrangement of the multiple image forming units 20K, 20Y, 20M, and 20C, the conveyance belt 43, and the optical sensors 28*a*, 28*b*, and 28*c* constituting the detector 28 in the image forming apparatus according to the first embodiment.

The image forming unit 20K includes the head unit 23K including the optical head (first optical head) 23Ka that forms an electrostatic latent image on the photosensitive drum 21K in a first region Ra in the main scanning direction D2 and the optical head (second optical head) 23Kb that forms an electrostatic latent image on the photosensitive drum 21K in a second region Rb in the main scanning direction D2. The image forming unit 20Y includes the head unit 23Y including the optical head (first optical head) 23Ya that forms an electrostatic latent image on the photosensitive drum 21Y in the first region Ra in the main scanning direction D2 and the optical head (second optical head) 23Yb that forms an electrostatic latent image on the photosensitive drum 21Y in the second region Rb in the main scanning direction D2. The image forming unit 20M includes the head unit 23M including the optical head (first optical head) 23Ma that forms an electrostatic latent image on the photosensitive drum 21M in the first region Ra in the main scanning direction D2 and the optical head (second optical head) 23Mb that forms an electrostatic latent image on the photosensitive drum 21M in the second region Rb in the main scanning direction D2. The image forming unit 20C includes the head unit 23C including the optical head (first optical head) 23Ca that forms an electrostatic latent image on the photosensitive drum 21C in the first region Ra in the main scanning direction D2 and the optical head (second optical head) 23Cb that forms an electrostatic latent image on the photosensitive drum 21C in the second region Rb in the main scanning direction D2.

As illustrated in FIG. 3, in each of the image forming units 20K, 20Y, 20M, and 20C, the first optical head 23Ka, 23Ya, 23Ma, or 23Ca and the second optical head 23Kb, 23Yb, 23Mb, or 23Cb are disposed at different positions in the sub-scanning direction (corresponding to the traveling direction D1) perpendicular to the main scanning direction D2. End portions of the first optical heads 23Ka, 23Ya, 23Ma, and 23Ca and end portions of the second optical heads 23Kb, 23Yb, 23Mb, and 23Cb have an overlap portion (first overlap portion) Xa where the end portions of the first optical heads 23Ka, 23Ya, 23Ma, and 23Ca and the end portions of the second optical heads 23Kb, 23Yb, 23Mb, and 23Cb overlap each other in the main scanning direction D2. Thus, in the plan view of FIG. 3, the multiple optical heads 23Ka, 23Kb, 23Ya, 23Yb, 23Ma, 23Mb, 23Ca, and 23Cb are arranged in a staggered or zigzag manner.

The first optical heads 23Ka, 23Ya, 23Ma, and 23Ca in the image forming units 20K, 20Y, 20M, and 20C constitute the first optical head group 23*a*. The second optical heads 23Kb, 23Yb, 23Mb, and 23Cb in the image forming units 20K, 20Y, 20M, and 20C constitute the second optical head group 23*b*.

The detector 28 includes the first optical sensor 28*a*, second optical sensor 28*b*, and third optical sensor 28*c*. The first optical sensor 28*a* is used to detect positions of transferred developer images formed by transferring onto the conveyance belt 43 developer images formed by exposure of the first optical heads 23Ka, 23Ya, 23Ma, and 23Ca and development of the developing units 24K, 24Y, 24M, and 24C. The second optical sensor 28*b* is used to detect positions of transferred developer images formed by transferring onto the conveyance belt 43 developer images formed by exposure of the optical heads 23Ka, 23Kb, 23Ya, 23Yb, 23Ma, 23Mb, 23Ca, and 23Cb and development of the developing units 24K, 24Y, 24M, and 24C in a region corresponding to the overlap portion Xa. The third optical sensor 28*c* is used to detect positions of transferred developer images formed by transferring onto the conveyance belt 43 developer images formed by exposure of the second optical heads 23Kb, 23Yb, 23Mb, and 23Cb and development of the developing units 24K, 24Y, 24M, and 24C. The first optical sensor 28*a*, second optical sensor 28*b*, and third optical sensor 28*c* can detect difference in reflectance between an area in which a detection pattern image, which is a transferred developer image, is formed on the conveyance belt 43 and an area in which no detection pattern image is formed on the conveyance belt 43, difference in reflectance due to the colors of transferred developer images, or the like. The diameter Y of a light receiving spot of the second optical sensor 28*b* is preferably smaller than the width of the overlap portion Xa.

<1-2> Operation of First Embodiment

Figure 4:
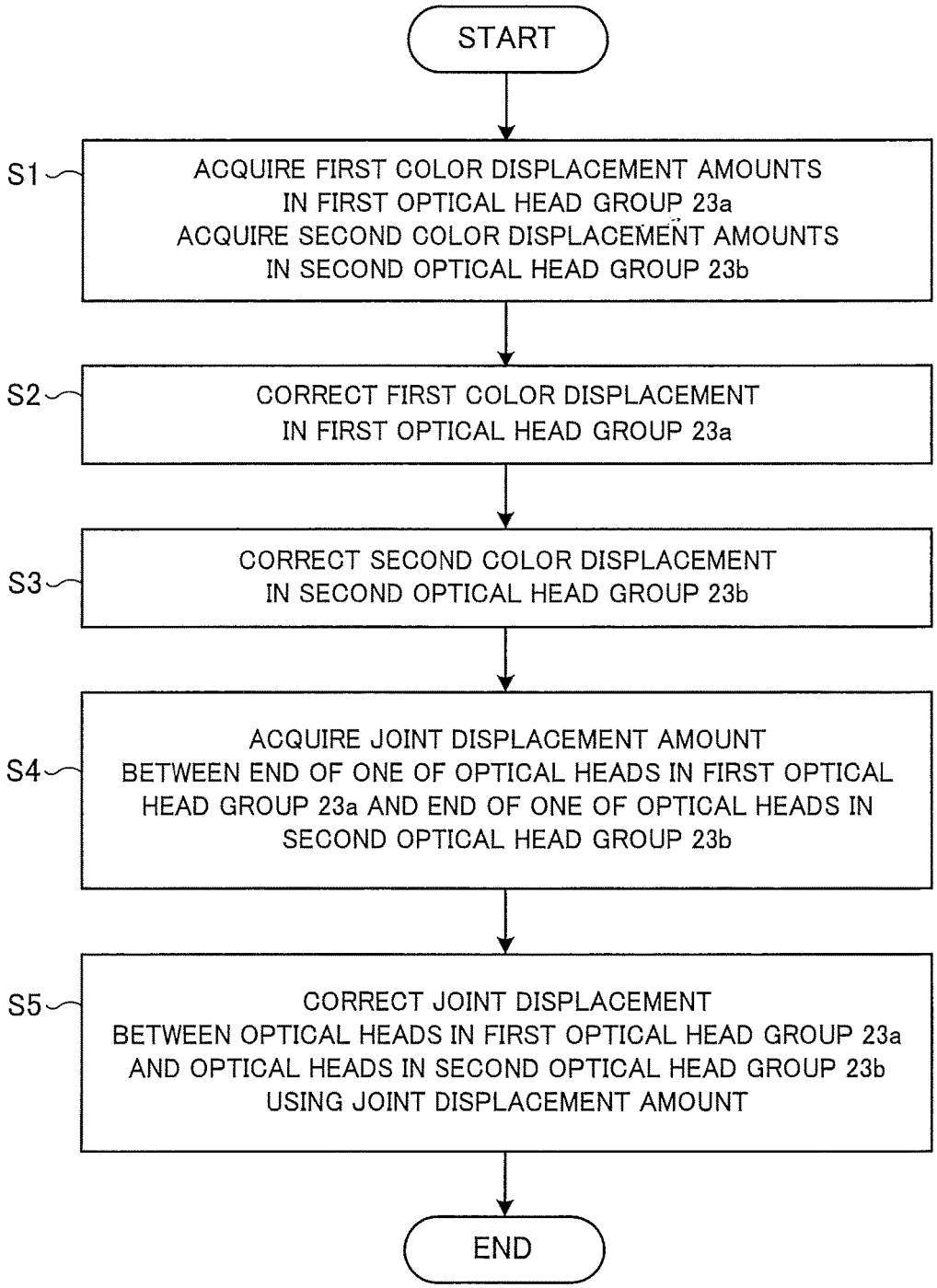
FIG. 4 is a flowchart illustrating an example of an image displacement correction process in the image forming apparatus according to the first embodiment.

FIG. 4 is a flowchart illustrating an example of the image displacement correction process (image displacement correction method according to the first embodiment) by the image forming apparatus 1.

In step S1, the controller 81 acquires, based on the detection by the optical sensors 28*a* and 28*b*, one or more first color displacement amounts (first displacement amounts) between a position of a first transferred developer image and positions of one or more second transferred developer images. The first transferred developer image is a transferred developer image corresponding to an electrostatic latent image formed by a reference first optical head (for example, the first optical head 23Ka) that is one of the multiple first optical heads 23Ka, 23Ya, 23Ma, and 23Ca in the first optical head group 23*a*. The second transferred developer images are transferred developer images corresponding to electrostatic latent images formed by one or more first optical heads (for example, the first optical heads 23Ya, 23Ma, and 23Ca) other than the reference first optical head in the first optical head group 23*a*. Specifically, each of the one or more first color displacement amounts includes a displacement amount (or component) Δvc1 in the traveling direction D1 and a displacement amount (or component) Δhc1 in the main scanning direction D2 between the first transferred developer image and the second transferred developer image. For each of the one or more first optical heads other than the reference first optical head, the controller 81 acquires the displacement amounts Δvc1 and Δhc1. However, the controller 81 may acquire one of the displacement amounts Δvc1 and Δhc1.

Moreover, in step S1, the controller 81 acquires, based on the detection by the optical sensors 28*b* and 28*c*, one or more second color displacement amounts (second displacement amounts) between a position of a third transferred developer image and positions of one or more fourth transferred developer images. The third transferred developer image is a transferred developer image corresponding to an electrostatic latent image formed by a reference second optical head (for example, the second optical head 23Kb) that is one of the multiple second optical heads 23Kb, 23Yb, 23Mb, and 23Cb in the second optical head group 23*b*. The fourth transferred developer images are transferred developer images corresponding to electrostatic latent images formed by one or more second optical heads (for example, the second optical heads 23Yb, 23Mb, and 23Cb) other than the reference second optical head in the second optical head group 23*b*. Specifically, each of the one or more second color displacement amounts includes a displacement amount (or component) Δvc2 in the traveling direction D1 and a displacement amount (or component) Δhc2 in the main scanning direction D2 between the third transferred developer image and the fourth transferred developer image. For each of the one or more second optical heads other than the reference second optical head, the controller 81 acquires the displacement amounts Δvc2 and Δhc2. However, the controller 81 may acquire one of the displacement amounts Δvc2 and Δhc2.

In step S2, the controller 81 sets, based on the first color displacement amounts in the first optical head group 23*a*, conditions for formation of electrostatic latent images by the first optical head group 23*a* so that the position of the first transferred developer image and the positions of the second transferred developer images approach (preferably, coincide with) each other. Specifically, the controller 81 sets light emission times and light emission positions in the main scanning direction D2 of the multiple first optical heads in the first optical head group 23*a*. Thereby, the controller 81 corrects color displacement (or displacement) in the traveling direction D1 and main scanning direction D2. However, the controller 81 may set one of the light emission times and light emission positions. The controller 81 may correct color displacement (or displacement) in one of the traveling direction D1 and main scanning direction D2.

In step S3, the controller 81 sets, based on the second color displacement amounts in the second optical head group 23*b*, conditions for formation of electrostatic latent images by the second optical head group 23*b* so that the position of the third transferred developer image and the positions of the fourth transferred developer images approach (preferably, coincide with) each other. Specifically, the controller 81 sets light emission times and light emission positions in the main scanning direction D2 of the multiple second optical heads in the second optical head group 23*b*. Thereby, the controller 81 corrects color displacement (or displacement) in the traveling direction D1 and main scanning direction D2. However, the controller 81 may set one of the light emission times and light emission positions. The controller 81 may correct color displacement (or displacement) in one of the traveling direction D1 and main scanning direction D2.

In step S4, the controller 81 acquires, based on the detection by the second optical sensor 28*b*, a first joint displacement amount that is a displacement amount between an end portion of a fifth transferred developer image and an end portion of a sixth transferred developer image. The fifth transferred developer image is a transferred developer image corresponding to an electrostatic latent image formed by one of the multiple first optical heads in the first optical head group 23*a*. The sixth transferred developer image is a transferred developer image corresponding to an electrostatic latent image formed by one of the multiple second optical heads in the second optical head group 23*b*. Specifically, the first joint displacement amount includes a displacement amount (or component) Δvj1 in the traveling direction D1 and a displacement amount (or component) Δhj1 in the main scanning direction D2 between the end portion of the fifth transferred developer image and the end portion of the sixth transferred developer image. The controller 81 acquires the displacement amounts Δvj1 and Δhj1. However, the controller 81 may acquire one of the displacement amounts Δvj1 and Δhj1.

In step S5, the controller 81 sets, based on the first joint displacement amount, conditions for formation of electrostatic latent images by the first optical head group 23*a* and conditions for formation of electrostatic latent images by the second optical head group 23*b* so that the end portion of the fifth transferred developer image and the end portion of the sixth transferred developer image approach (preferably, coincide with) each other. Specifically, the controller 81 sets light emission times and light emission positions in the main scanning direction D2 of the multiple first optical heads in the first optical head group 23*a* and the multiple second optical heads in the second optical head group 23*b*. Thereby, the controller 81 corrects joint displacement (or displacement) in the traveling direction D1 and main scanning direction D2. However, the controller 81 may set one of the light emission times and light emission positions. The controller 81 may correct joint displacement (or displacement) in one of the traveling direction D1 and main scanning direction D2.

The order of steps S1 to S5 in FIG. 4 is not limited to the example of FIG. 4. For example, the process may be performed in the order of steps S1, S4, S2, S3, and S5, or in the order of steps S1, S4, S3, S2, and S5.

Figure 5:
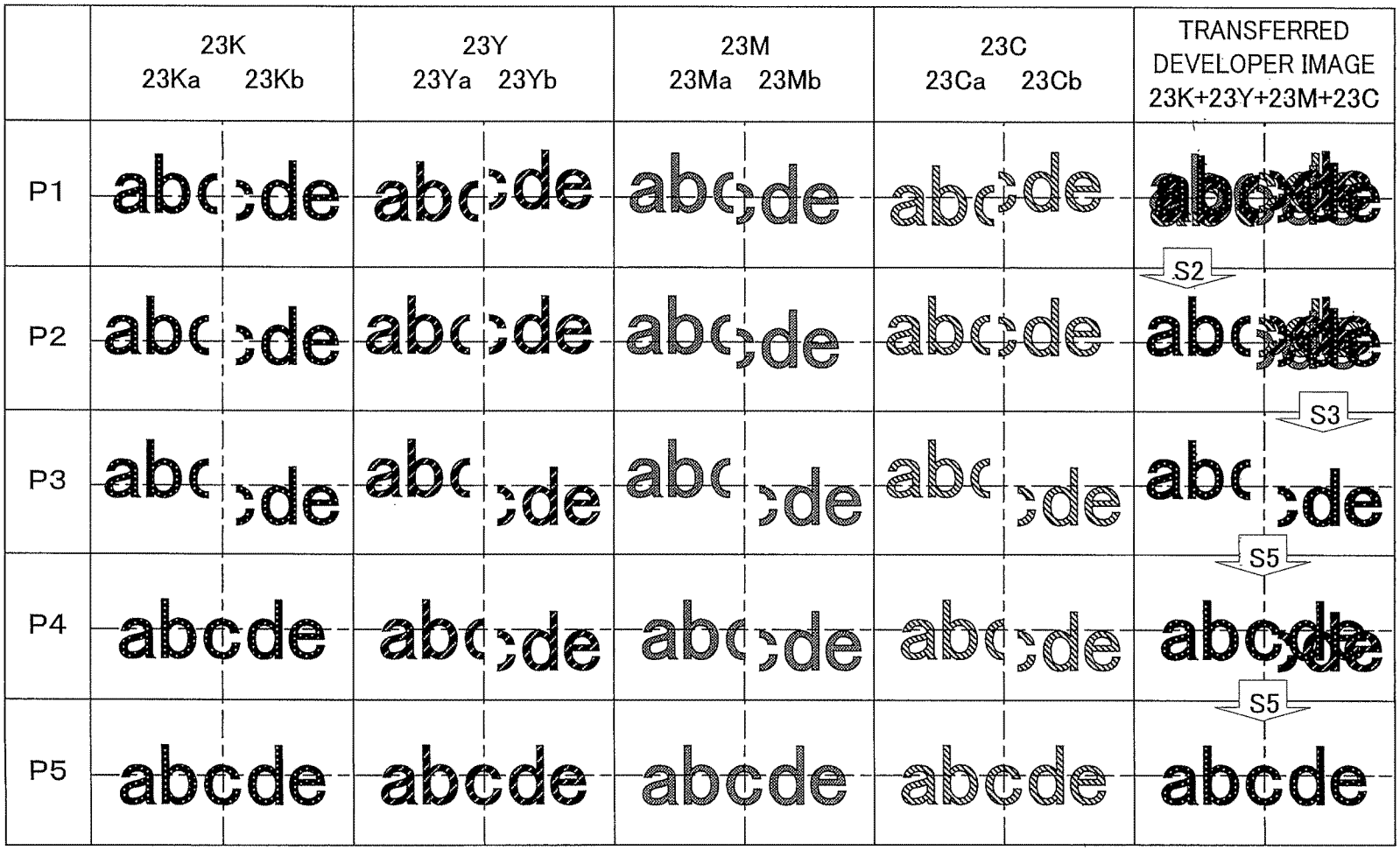
FIG. 5 is an explanatory diagram illustrating a relationship between the image displacement correction process and transferred developer images in the image forming apparatus according to the first embodiment.

FIG. 5 is an explanatory diagram illustrating the image displacement correction process in the image forming apparatus 1 according to the first embodiment. FIG. 5 illustrates how displacement of transferred developer images is corrected by the process illustrated in FIG. 4.

Images P1 illustrated in FIG. 5 are an example of images formed before the image displacement correction process is started (before step S1 in FIG. 4). In each of the transferred developer images "abcde", the left character string "abc" is a transferred developer image corresponding to an electrostatic latent image formed by the first optical head in the first optical head group 23*a*, and the right character string "cde" is a transferred developer image corresponding to an electrostatic latent image formed by the second optical head in the second optical head group 23*b*. In each of the head units, the character "c" in the character string "abcde" is divided into two.

In the transferred developer images P1 illustrated in FIG. 5, the positions of the transferred developer images "abcde" formed by the four image forming units 20K, 20Y, 20M, and 20C are displaced from each other. This is because conditions, such as times and positions, for forming electrostatic latent images have not been adjusted in the first optical head group 23*a* and the second optical head group 23*b*. Moreover, in the images P1, in each of the character strings "abode", the character "c" is separated into two parts, and displacement occurs. Such displacement (i.e., displacement between two adjacent transferred developer images) is referred to as joint displacement. This is because the positions at which electrostatic latent images are formed have not been adjusted between the first optical head 23Ka and the second optical head 23Kb in the head unit 23K. The same applies to the other head units 23Y, 23M, and 23C.

Images P2 in FIG. 5 illustrate a state after completion of step S2 in FIG. 4. Images P3 in FIG. 5 illustrate a state after completion of step S3 in FIG. 4. Images P4 in FIG. 5 illustrate a state in the middle of step S5 in FIG. 4, and images P5 in FIG. 5 illustrate a state after completion of step S5 in FIG. 4.

<1-3> Measurement of Joint Displacement Amount

Next, a method of measuring the joint displacement amount between the first optical head 23Ca and the second optical head 23Kb in step S4 of FIG. 4 will be described. FIGS. 6A to 6D are diagrams illustrating a process of measuring the joint displacement (displacement in the traveling direction D1). FIGS. 6A to 6D illustrate an example of detection pattern images used for measurement of the displacement amount in the sub-scanning direction of the optical heads. FIGS. 6A to 6D illustrate the detection pattern images formed on the conveyance belt 43 when the displacement amount in the traveling direction D1 (corresponding to the sub-scanning direction of the optical heads) of the conveyance belt 43 is measured. As illustrated in FIGS. 6A to 6D, the detection pattern images are images corresponding to electrostatic latent images formed in the overlap portion Xa.

Figure 6A:
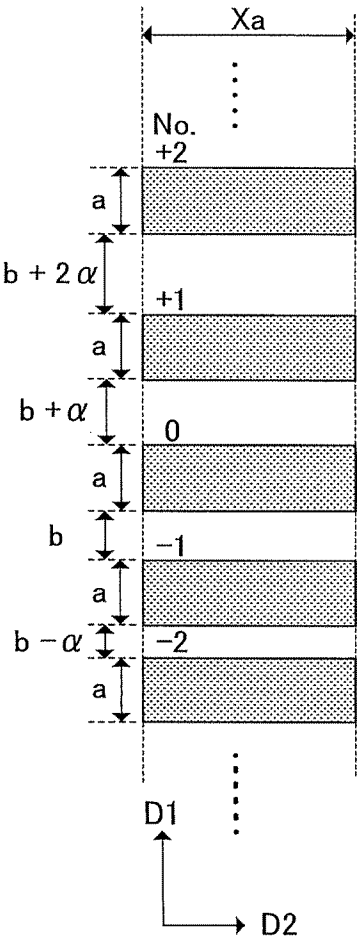
FIGS. 6A to 6D are diagrams illustrating a process for correcting joint displacement (displacement in a traveling direction)

FIG. 6A illustrates, for example, a detection pattern image corresponding to an electrostatic latent image formed by the first optical head 23Ca. This detection pattern image is a cyan toner image. In FIG. 6A, the detection pattern image is a stripe image consisting of multiple band images. The band images each have a width a in the traveling direction D1. In the main scanning direction D2, the band images each have a length equal to that of the overlap portion Xa. The band images are arranged in the traveling direction D1 at intervals of $b-2\alpha$, $b-\alpha$, b, $b+\alpha$, $b+2\alpha$, . . . , for example. However, the intervals between the band images are not limited to the example of FIG. 6A, and an arrangement in which the same interval is repeated multiple times may be employed. For example, the band images may be arranged at intervals of $b-2\alpha$, $b-2\alpha$, $b-\alpha$, $b-\alpha$, b, b, $b+\alpha$, $b+\alpha$, $b+2\alpha a$, $b+2\alpha$, . . . , or at intervals of $b-2\alpha$, $b-2\alpha$, $b-2\alpha$, $b-\alpha$, $b-\alpha$, $b-\alpha$, b, b, b, $b+\alpha$, $b+\alpha$, $b+\alpha$, $b+2\alpha$, $b+2\alpha$, $b+2\alpha$, . . . For the purpose of explanation, the band images constituting the stripe detection pattern image in FIG. 6A are assigned numbers 0, ±1, ±2, . . .

Figure 6B:
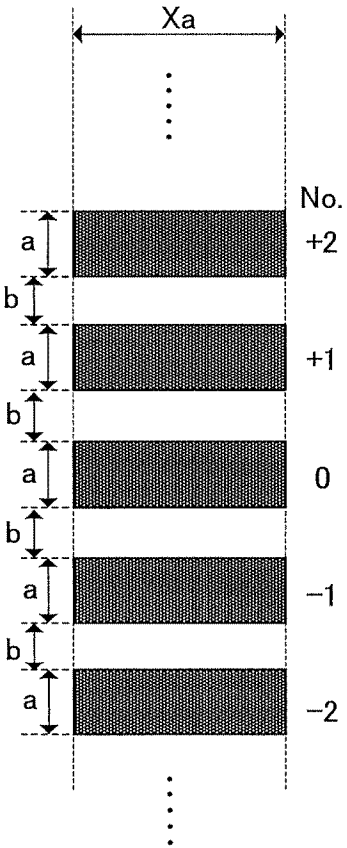

FIG. 6B illustrates a detection pattern image corresponding to an electrostatic latent image formed by the second optical head 23Kb. This detection pattern image is a black toner image. In FIG. 6B, the detection pattern image is a stripe image consisting of multiple band images. The band images each have a width a in the traveling direction D1. In the main scanning direction D2, the band images each have a length equal to that of the overlap portion Xa. The band images are arranged in the traveling direction D1 at regular intervals b. For the purpose of explanation, the band images constituting the stripe detection pattern image in FIG. 6B are assigned numbers 0, ±1, ±2, . . .

Figure 6C:
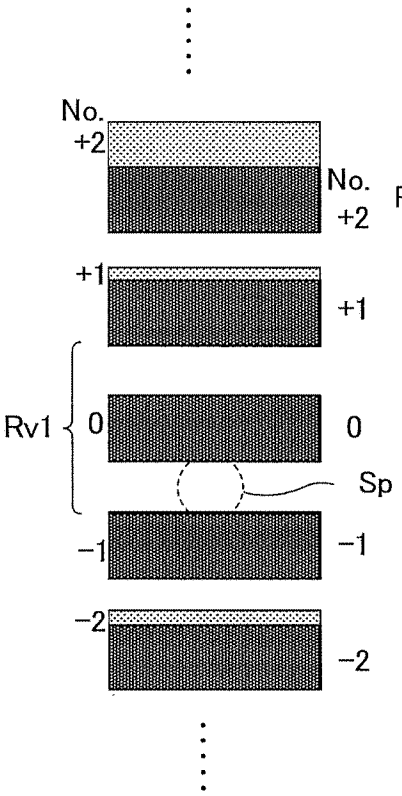
Figure 6D:
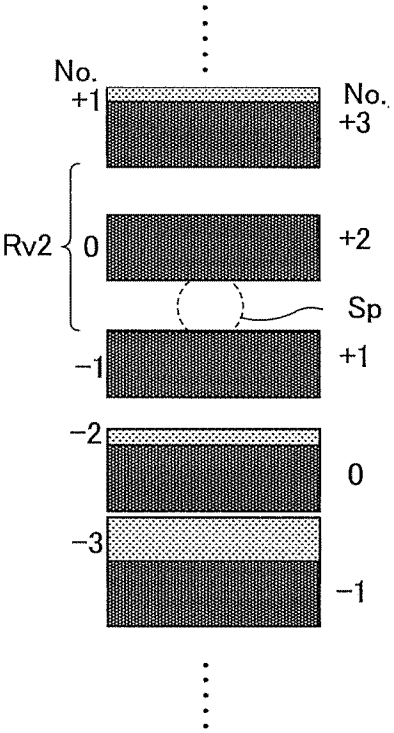

FIGS. 6C and 6D illustrate cases in which the detection pattern images illustrated in FIGS. 6A and 6B are formed on the conveyance belt 43. In each of FIGS. 6C and 6D, the numbers shown on the left side correspond to the numbers assigned to the band images of the first optical head 23Ca illustrated in FIG. 6A, and the numbers shown on the right side correspond to the numbers assigned to the band images of the second optical head 23Kb illustrated in FIG. 6B. FIG. 6C illustrates a case in which no joint displacement occurs in the traveling direction D1. In FIG. 6C, the No. 0 band image formed by the second optical head 23Kb and the No. 0 band image formed by the first optical head 23Ca overlap each other, and the positions of the band images coincide with each other. In FIG. 6C, the region Rv1 including the No. 0 band images is a region where the surface of the conveyance belt 43 is most widely exposed. A region where the surface of the conveyance belt 43 is exposed reflects light most strongly, followed by a region where a cyan toner image is formed, and a region where a black toner image is formed (and a region where a cyan toner image and a black toner image are superimposed). Thus, a light receiving spot Sp of the second optical sensor 28*b* receives the strongest reflected light in the region Rv1. Moreover, reflectance detected by the second optical sensor 28*b* decreases in the order of a region where the surface of the conveyance belt 43 is exposed, a region where a cyan toner image is formed, and a region where a black toner image is formed.

FIG. 6D illustrates a case in which joint displacement occurs in the traveling direction D1. In FIG. 6D, the position of the No. +2 band image formed by the second optical head 23Kb and the position of the No. 0 band image formed by the first optical head 23Ca coincide with each other. In this case, the light receiving spot Sp of the second optical sensor 28*b* receives the strongest reflected light in the region Rv2.

Figure 7A:
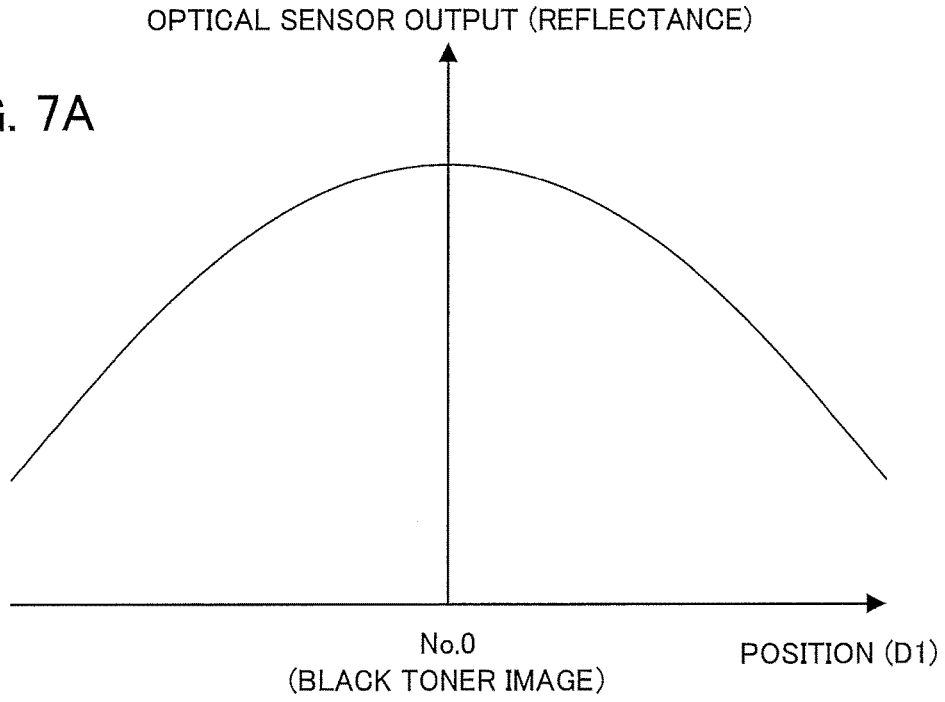
FIGS. 7A and 7B are diagrams illustrating outputs of a detector in FIGS. 6C and 6D.
Figure 7B:
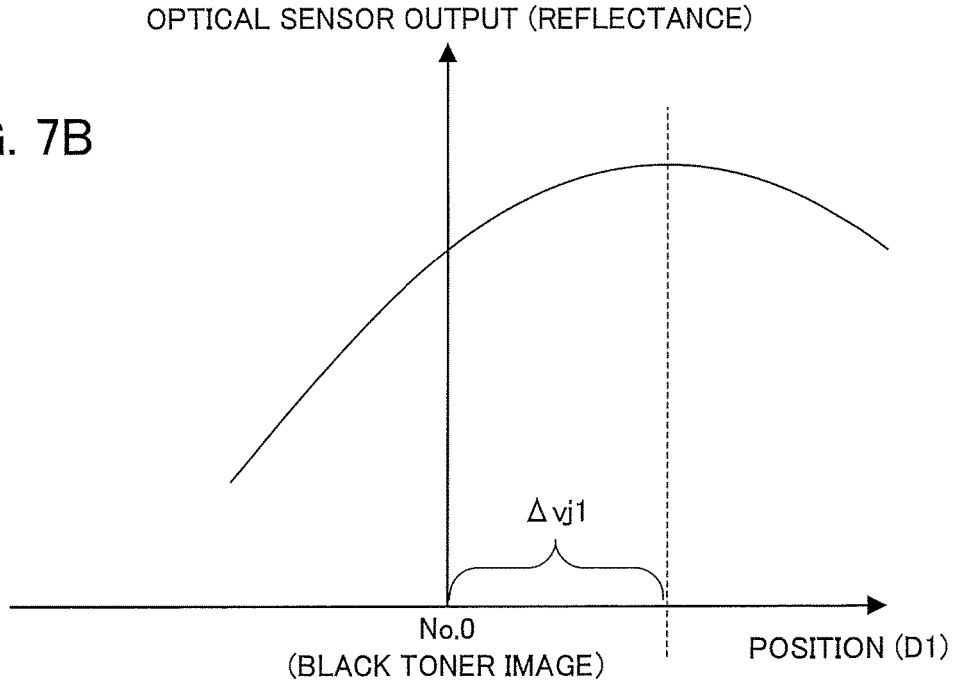

FIG. 7A is a diagram illustrating the reflectance measured from the detection pattern images illustrated in FIG. 6C. FIG. 7B is a diagram illustrating the reflectance measured from the detection pattern images illustrated in FIG. 6D. The image forming apparatus 1 measures, as the displacement amount $\Delta vj1$ in the traveling direction D1, the distance from a reference position (for example, a position of the black No. 0 band image) to the position at which the reflectance is highest.

Next, measurement of the displacement amount in the main scanning direction D2 will be described. FIGS. 8A to 8D are diagrams illustrating an example of detection pattern images used for measurement of the displacement amount in the main scanning direction D2 of the optical heads. The detection pattern images illustrated in FIGS. 8A to 8D are formed on the conveyance belt 43.

Figures 8A, 8B, 8C, 8D:
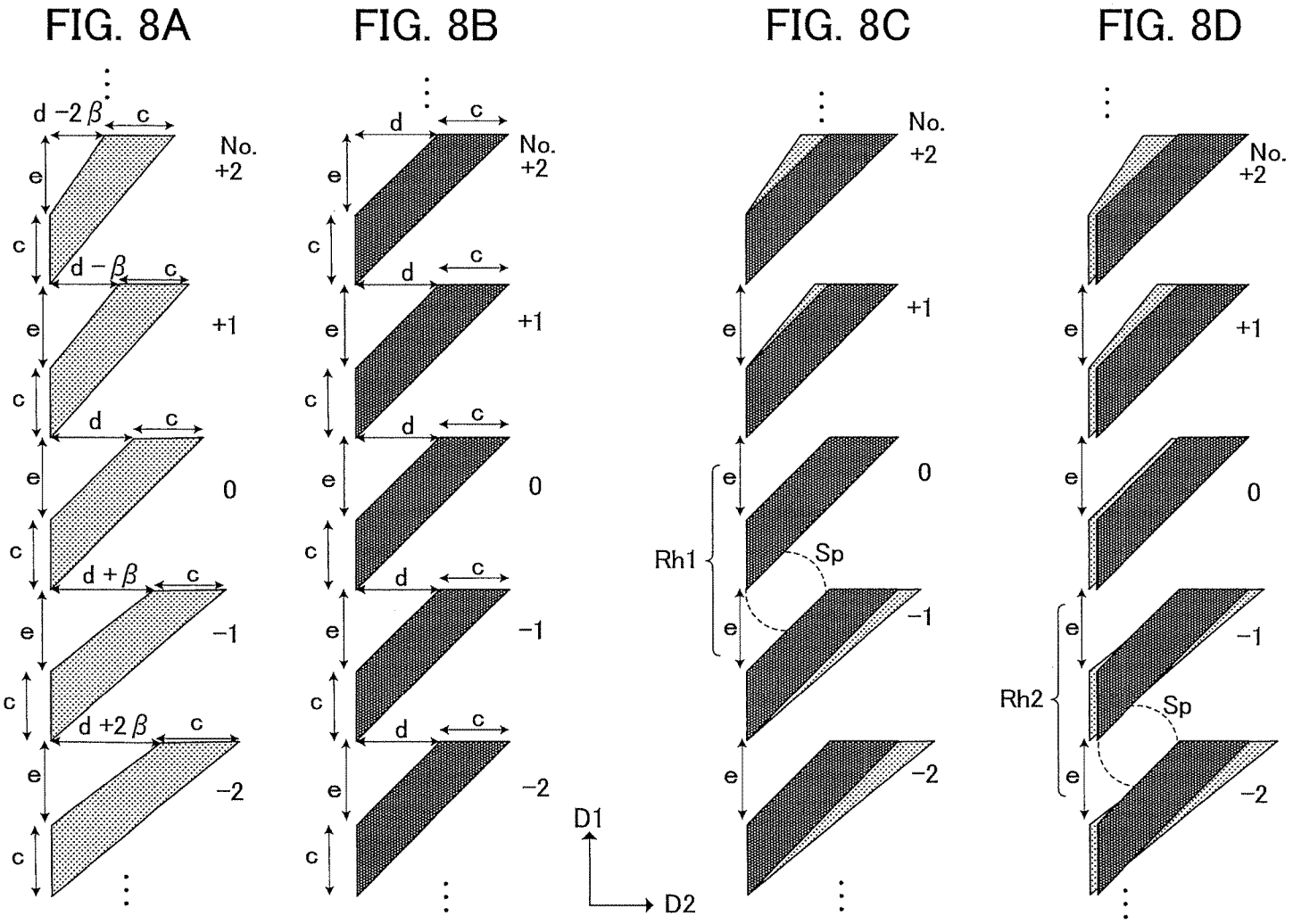
FIGS. 8A to 8D are diagrams illustrating a process for correcting joint displacement (displacement in a main scanning direction)

FIG. 8A illustrates a detection pattern image corresponding to an electrostatic latent image formed by the first optical head 23Ca. This detection pattern image is a cyan toner image. In FIG. 8A, the detection pattern image is a stripe image consisting of multiple band images. The band images each have a width c in the main scanning direction D2. The band images are formed obliquely. The inclinations of sides of the band images decrease so that the sides have lengths of d-2β, d-β, d, d+β, d+2β, . . . in the main scanning direction D2 while they have a length of e in the sub-scanning direction D1, for example. The inclinations of the sides of the band images are not limited to the example of FIG. 8A, and an arrangement in which a band image with the same inclination is repeated multiple times may be employed. For example, the band images may be arranged so that a band image with the same inclination is repeated multiple times. For example, band images may be arranged so that sides of the band images have lengths of d−2β, d−2β, d−β, d−β, d, d, d+β, d+β, d+2β, d+2β, . . . in the main scanning direction D2 while they have a length of e in the sub-scanning direction D1. For the purpose of explanation, the band images in FIG. 8A are assigned numbers 0, ±1, ±2, . . .

FIG. 8B illustrates a detection pattern image corresponding to an electrostatic latent image formed by the second optical head 23Kb. This detection pattern image is a black toner image. In FIG. 8B, the detection pattern image is a stripe image consisting of multiple band images. The band images each have a width c in the main scanning direction D2. The band images are formed obliquely. The inclinations of sides of the band images are constant in such a manner that, for example, the sides have a length d in the main scanning direction D2 while they have a length e in the sub-scanning direction D1. For the purpose of explanation, the band images in FIG. 8B are assigned numbers 0, ±1, ±2, . . .

FIGS. 8C and 8D illustrate cases in which the detection pattern images illustrated in FIGS. 8A and 8B are formed on the conveyance belt 43. The numbers shown in FIGS. 8C and 8D correspond to the numbers assigned to the band images of the second optical head 23Kb illustrated in FIG. 8B. FIG. 8C illustrates a case in which no joint displacement occurs. In FIG. 8C, the No. 0 band image formed by the second optical head 23Kb and the No. 0 band image formed by the first optical head 23Ca overlap each other, and the positions of the band images coincide with each other. In FIG. 8C, the region Rh1 including the No. 0 band images is a region where the surface of the conveyance belt 43 is most widely exposed. As in the case of FIG. 6C, the light receiving spot Sp of the second optical sensor 28*b* receives the strongest reflected light in the region Rh1.

FIG. 8D illustrates a case in which joint displacement occurs due to displacement of the cyan detection pattern image illustrated in FIG. 8A in the main scanning direction D2 (left direction in FIG. 8D). In FIG. 8D, the light receiving spot Sp of the second optical sensor 28*b* receives the strongest reflected light in the region Rh2.

Figure 9A:
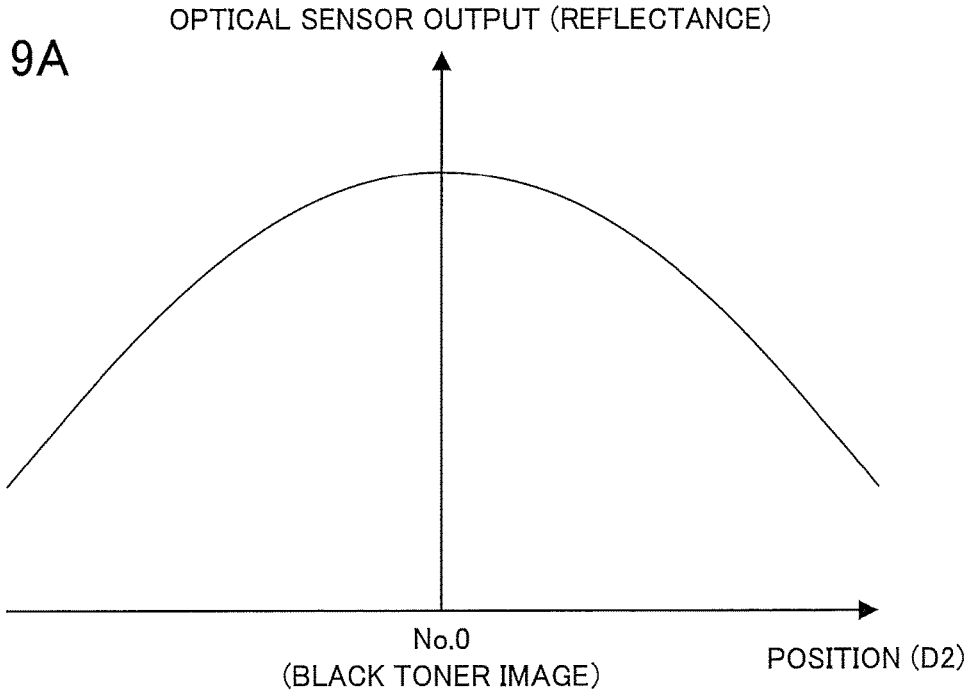
FIGS. 9A and 9B are diagrams illustrating outputs of the detector in FIGS. 8C and 8D.
Figure 9B:
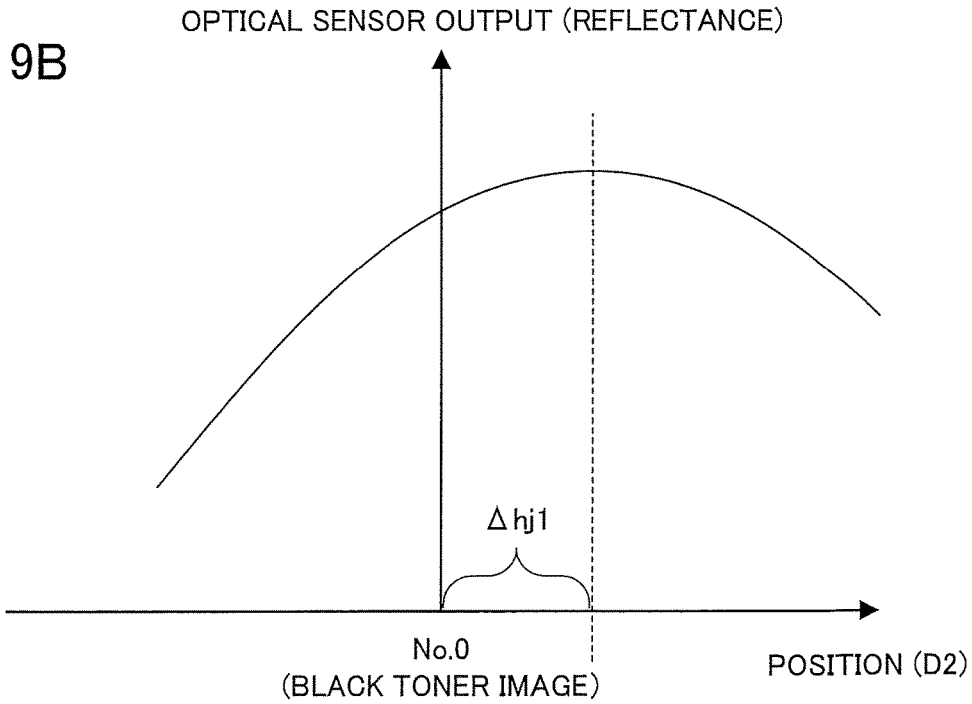

FIG. 9A is a diagram illustrating the reflectance measured from the detection pattern images illustrated in FIG. 8C. FIG. 9B is a diagram illustrating the reflectance measured from the detection pattern images illustrated in FIG. 8D. The image forming apparatus 1 measures, as the displacement amount Δhj1 in the main scanning direction D2, the distance from a reference position (for example, a position of the black No. 0 band image) to the position at which the reflectance is highest. A method of calculating a joint displacement amount is described in Japanese Patent Application Publication No. 2011-194684, for example.

As described above, the displacement amounts Δvj1 and Δhj1 between the first optical head 23Ca and the second optical head 23Kb are acquired. Here, in the first optical head group 23*a* and the second optical head group 23*b*, correction of color displacement has been performed for each of the optical heads. Thus, for example, by performing correction on the second optical heads in the second optical head group 23*b* based on the displacement amounts Δvj1 and Δhj1 with the first optical head 23Ca as a reference (or by performing correction on the first optical heads in the first optical head group 23*a* based on the displacement amounts Δvj1 and Δhj1 with the second optical head 23Kb as a reference), the joint displacement between the first optical head group 23*a* and the second optical head group 23*b* can be eliminated.

<1-4> Advantages

As described above, in the image displacement correction process of the image forming apparatus 1 according to the first embodiment, detection pattern images need to be formed when color displacements of detection pattern images formed by the first optical heads in the first optical head group 23*a* are acquired and color displacements of detection pattern images formed by the second optical heads in the second optical head group 23*b* are acquired (step S1), and when a color displacement of detection pattern images formed by one of the first optical heads in the first optical head group 23*a* and one of the second optical heads in the second optical head group 23*b* is acquired (step S4). In step S4 of the first embodiment, it is sufficient to acquire the joint displacement (Δvj1, Δhj1) between a detection pattern image formed by one of the first optical heads in the first optical head group 23*a* and a detection pattern image formed by one of the second optical heads in the second optical head group 23*b*. Thus, it is possible to reduce the time required for the image displacement correction process, as compared with a method of acquiring a displacement (joint displacement) between detection pattern images for each combination of one of the multiple first optical heads in the first optical head group 23*a* and one of the multiple second optical heads in the second optical head group 23*b*.

Second Embodiment

<2-1>Configuration of Second Embodiment

An image forming apparatus according to a second embodiment will be described below. In the above first embodiment, each of the head units includes two optical heads (first optical head and second optical head). In the second embodiment, each head unit includes three optical heads (a first optical head, a second optical head, and a third optical head). Except for this, the image forming apparatus according to the second embodiment is the same as the image forming apparatus 1 according to the first embodiment. Thus, the image forming apparatus according to the second embodiment will be described with reference to FIGS. 1 and 2.

Figure 10:
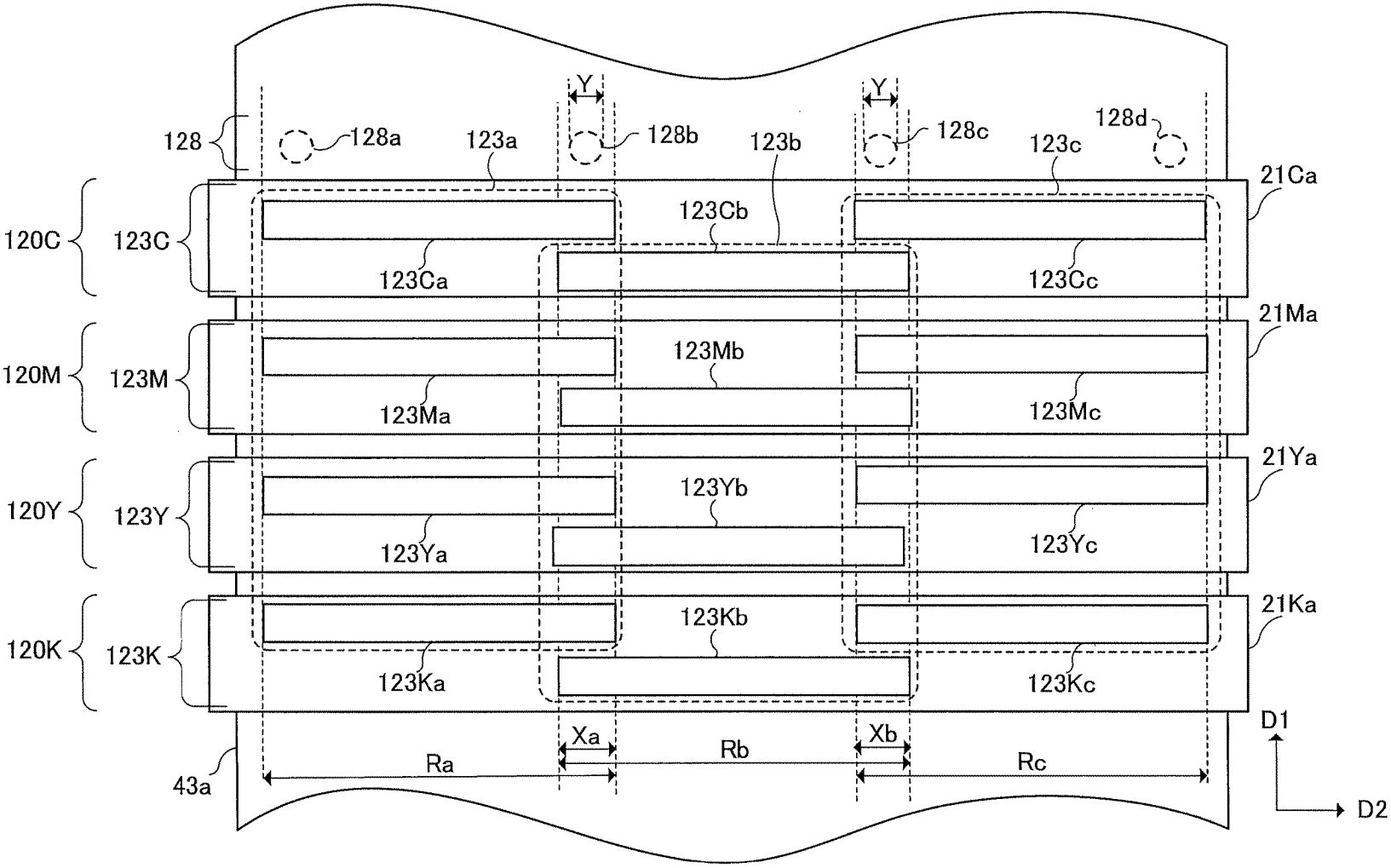
FIG. 10 is a plan view schematically illustrating an arrangement of multiple image forming units, a conveyance belt, and optical sensors in an image forming apparatus according to a second embodiment.

FIG. 10 is a plan view schematically illustrating an arrangement of components of the image forming apparatus according to the second embodiment. In FIG. 10, the image forming apparatus includes multiple image forming units 120K, 120Y, 120M, and 120C, a conveyance belt 43*a*, and optical sensors 128*a*, 128*b*, 128*c*, and 128*d* constituting a detector 128. The image forming units 120K, 120Y, 120M, and 120C respectively include photosensitive drums 21Ka, 21Ya, 21Ma, and 21Ca.

The image forming unit 120K includes a head unit 123K including an optical head (first optical head) 123Ka that forms an electrostatic latent image on the photosensitive drum 21Ka in a first region Ra in the main scanning direction D2, an optical head (second optical head) 123Kb that forms an electrostatic latent image on the photosensitive drum 21Ka in a second region Rb in the main scanning direction D2, and an optical head (third optical head) 123Kc that forms an electrostatic latent image on the photosensitive drum 21Ka in a third region Rc in the main scanning direction D2. The image forming unit 120Y includes a head unit 123Y including an optical head (first optical head) 123Ya that forms an electrostatic latent image on the photosensitive drum 21Ya in the first region Ra in the main scanning direction D2, an optical head (second optical head) 123Yb that forms an electrostatic latent image on the photosensitive drum 21Ya in the second region Rb in the main scanning direction D2, and an optical head (third optical head) 123Yc that forms an electrostatic latent image on the photosensitive drum 21Ya in the third region Rc in the main scanning direction D2. The image forming unit 120M includes a head unit 123M including an optical head (first optical head) 123Ma that forms an electrostatic latent image on the photosensitive drum 21Ma in the first region Ra in the main scanning direction D2, an optical head (second optical head) 123Mb that forms an electrostatic latent image on the photosensitive drum 21Ma in the second region Rb in the main scanning direction D2, and an optical head (third optical head) 123Mc that forms an electrostatic latent image on the photosensitive drum 21Ma in the third region Rc in the main scanning direction D2. The image forming unit 120C includes a head unit 123C including an optical head (first optical head) 123Ca that forms an electrostatic latent image on the photosensitive drum 21Ca in the first region Ra in the main scanning direction D2, an optical head (second optical head) 123Cb that forms an electrostatic latent image on the photosensitive drum 21Ca in the second region Rb in the main scanning direction D2, and an optical head (third optical head) 123Cc that forms an electrostatic latent image on the photosensitive drum 21Ca in the third region Rc in the main scanning direction D2.

As illustrated in FIG. 10, in each of the image forming units 120K, 120Y, 120M, and 120C, the first optical head 123Ka, 123Ya, 123Ma, or 123Ca and the second optical head 123Kb, 123Yb, 123Mb, or 123Cb are disposed at different positions in the sub-scanning direction perpendicular to the main scanning direction D2. Moreover, in each of the image forming units 120K, 120Y, 120M, and 120C, the third optical head 123Kc, 123Yc, 123Mc, or 123Cc and the second optical head 123Kb, 123Yb, 123Mb, or 123Cb are disposed at different positions in the sub-scanning direction. Moreover, in each of the image forming units 120K, 120Y, 120M, and 120C, the first optical head 123Ka, 123Ya, 123Ma, or 123Ca and the third optical head 123Kc, 123Yc, 123Mc, or 123Cc are disposed at the same position in the sub-scanning direction. End portions of the first optical heads 123Ka, 123Ya, 123Ma, and 123Ca and end portions of the second optical heads 123Kb, 123Yb, 123Mb, and 123Cb have an overlap portion (first overlap portion) Xa where the end portions of the first optical heads 123Ka, 123Ya, 123Ma, and 123Ca and the end portions of the second optical heads 123Kb, 123Yb, 123Mb, and 123Cb overlap each other in the main scanning direction D2. End portions of the third optical heads 123Kc, 123Yc, 123Mc, and 123Cc and the other end portions of the second optical heads 123Kb, 123Yb, 123Mb, and 123Cb have an overlap portion (second overlap portion) Xb where the end portions of the third optical heads 123Kc, 123Yc, 123Mc, and 123Cc and the other end portions of the second optical heads 123Kb, 123Yb, 123Mb, and 123Cb overlap each other in the main scanning direction D2. Thus, in the plan view of FIG. 10, the multiple optical heads 123Ka, 123Kb, 123Kc, 123Ya, 123Yb, 123Yc, 123Ma, 123Mb, 123Mc, 123Ca, 123Cb, and 123Cc are arranged in a staggered or zigzag manner.

The first optical heads 123Ka, 123Ya, 123Ma, and 123Ca in the image forming units 120K, 120Y, 120M, and 120C constitute a first optical head group 123*a*. The second optical heads 123Kb, 123Yb, 123Mb, and 123Cb in the image forming units 120K, 120Y, 120M, and 120C constitute a second optical head group 123*b*. The third optical heads 123Kc, 123Yc, 123Mc, and 123Cc in the image forming units 120K, 120Y, 120M, and 120C constitute a third optical head group 123*c*.

The detector 128 includes the first optical sensor 128*a*, second optical sensor 128*b*, third optical sensor 128*c*, and fourth optical sensor 128*d*. The first optical sensor 128*a* is used to detect positions of transferred developer images formed by transferring onto the conveyance belt 43*a* developer images formed by exposure of the first optical heads 123Ka, 123Ya, 123Ma, and 123Ca and development of the developing units 24K, 24Y, 24M, and 24C. The second optical sensor 128*b* is used to detect positions of transferred developer images formed by transferring onto the conveyance belt 43*a* developer images formed by exposure of the optical heads 123Ka, 123Kb, 123Ya, 123Yb, 123Ma, 123Mb, 123Ca, and 123Cb and development of the developing units 24K, 24Y, 24M, and 24C in a region corresponding to the overlap portion Xa. The third optical sensor 128*c* is used to detect positions of transferred developer images formed by transferring onto the conveyance belt 43*a* developer images formed by exposure of the optical heads 123Kb, 123Kc, 123Yb, 123Yc, 123Mb, 123Mc, 123Cb, and 123Cc and development of the developing units 24K, 24Y, 24M, and 24C. The fourth optical sensor 128*d* is used to detect positions of transferred developer images formed by transferring onto the conveyance belt 43*a* developer images formed by exposure of the third optical heads 123Kc, 123Yc, 123Mc, and 123Cc and development of the developing units 24K, 24Y, 24M, and 24C. The first optical sensor 128*a*, second optical sensor 128*b*, third optical sensor 128*c*, and fourth optical sensor 128*d* can detect difference in reflectance between an area in which a detection pattern image, which is a transferred developer image, is formed on the conveyance belt 43*a* and an area in which no detection pattern image is formed on the conveyance belt 43*a*, difference in reflectance due to the colors of transferred developer images, or the like. The diameter Y of light receiving spots of the second optical sensor 128*b* and third optical sensor 128*c* is preferably smaller than the length of the overlap portions Xa and Xb.

<2-2> Operation of Second Embodiment

Figure 11:
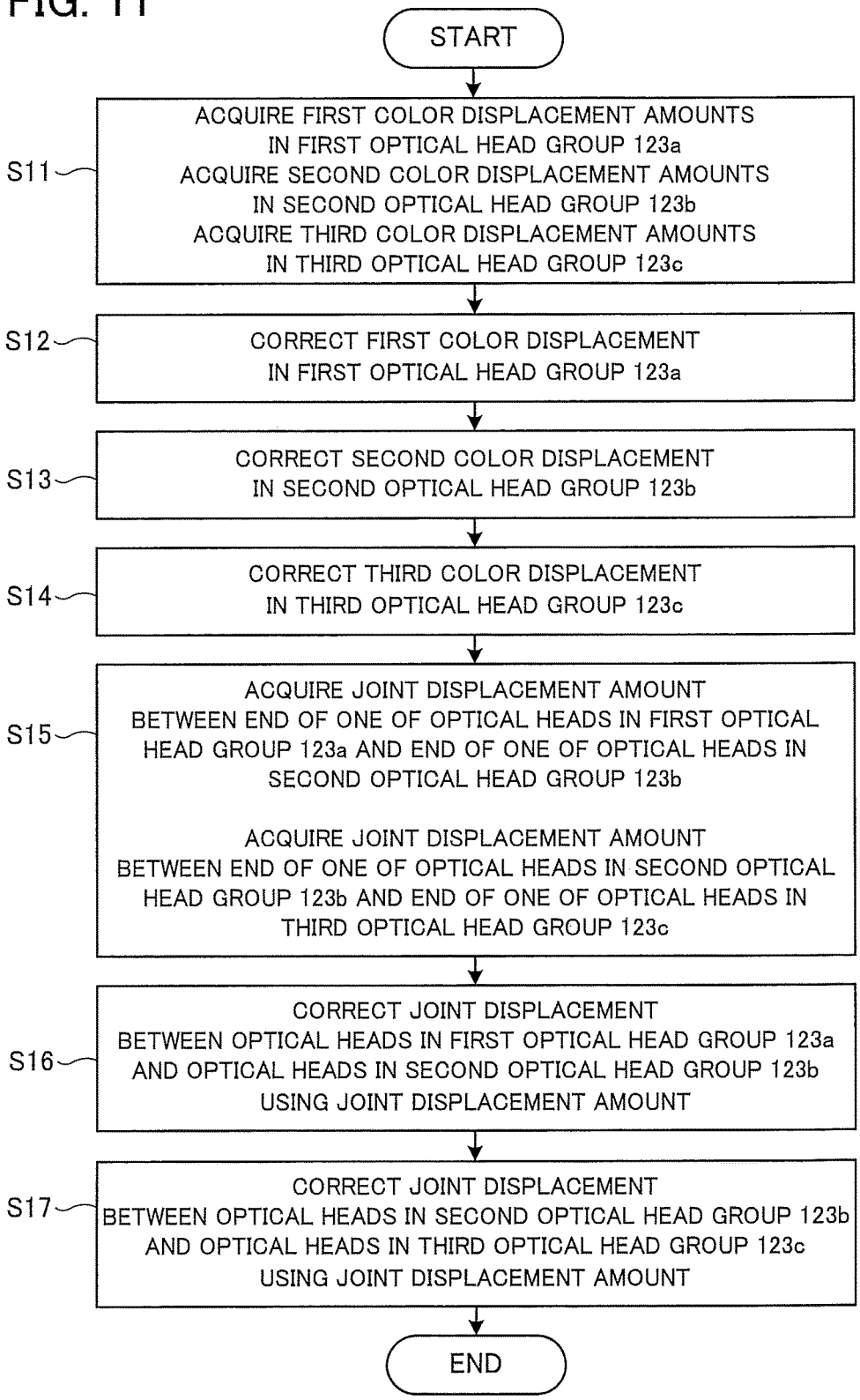
FIG. 11 is a flowchart illustrating an example of an image displacement correction process in the image forming apparatus according to the second embodiment.

FIG. 11 is a flowchart illustrating an example of an image displacement correction process (an image displacement correction method according to the second embodiment) in the image forming apparatus according to the second embodiment.

In step S11, the controller 81 acquires, based on the detection by the optical sensors 128*a* and 128*b*, one or more first color displacement amounts (first displacement amounts) between a position of a first transferred developer image and positions of one or more second transferred developer images. The first transferred developer image is a transferred developer image corresponding to an electrostatic latent image formed by a reference first optical head (for example, the first optical head 123Ka) that is one of the multiple first optical heads 123Ka, 123Ya, 123Ma, and 123Ca in the first optical head group 123*a*. The second transferred developer images are transferred developer images corresponding to electrostatic latent images formed by one or more first optical heads (for example, the first optical heads 123Ya, 123Ma, and 123Ca) other than the reference first optical head in the first optical head group 123*a*. Specifically, each of the one or more first color displacement amounts includes a displacement amount (or component) Δvc1 in the traveling direction D1 and a displacement amount (or component) Δhc1 in the main scanning direction D2 between the first transferred developer image and the second transferred developer image. For each of the one or more first optical heads other than the reference first optical head, the controller 81 acquires the displacement amounts Δvc1 and Δhc1. However, the controller 81 may acquire one of the displacement amounts Δvc1 and Δhc1.

In step S11, the controller 81 also acquires, based on the detection by the optical sensors 128*b* and 128*c*, one or more second color displacement amounts (second displacement amounts) between a position of a third transferred developer image and positions of one or more fourth transferred developer images. The third transferred developer image is a transferred developer image corresponding to an electrostatic latent image formed by a reference second optical head (for example, the second optical head 123Kb) that is one of the multiple second optical heads 123Kb, 123Yb, 123Mb, and 123Cb in the second optical head group 123*b*. The fourth transferred developer images are transferred developer images corresponding to electrostatic latent images formed by one or more second optical heads (for example, the second optical heads 123Yb, 123Mb, and 123Cb) other than the reference second optical head in the second optical head group 123*b*. Specifically, each of the one or more second color displacement amounts includes a displacement amount (or component) Δvc2 in the traveling direction D1 and a displacement amount (or component) Δhc2 in the main scanning direction D2 between the third transferred developer image and the fourth transferred developer image. For each of the one or more second optical heads other than the reference second optical head, the controller 81 acquires the displacement amounts Δvc2 and Δhc2. However, the controller 81 may acquire one of the displacement amounts Δvc2 and Δhc2.

In step S11, the controller 81 also acquires, based on the detection by the optical sensors 128*c* and 128*d*, one or more third color displacement amounts (third displacement amounts) between a position of a seventh transferred developer image and positions of one or more eighth transferred developer images. The seventh transferred developer image is a transferred developer image corresponding to an electrostatic latent image formed by a reference third optical head (for example, the third optical head 123Kc) that is one of the multiple third optical heads 123Kc, 123Yc, 123Mc, and 123Cc in the third optical head group 123*c*. The eighth transferred developer images are transferred developer images corresponding to electrostatic latent images formed by one or more third optical heads (for example, the third optical heads 123Yc, 123Mc, and 123Cc) other than the reference third optical head in the third optical head group 123*c*. Specifically, each of the one or more third color displacement amounts includes a displacement amount (or component) Δvc3 in the traveling direction D1 and a displacement amount (or component) Δhc3 in the main scanning direction D2 between the seventh transferred developer image and the eighth transferred developer image. For each of the one or more third optical heads other than the reference third optical head, the controller 81 acquires the displacement amounts Δvc3 and Δhc3. However, the controller 81 may acquire one of the displacement amounts Δvc3 and Δhc3.

In step S12, the controller 81 sets, based on the first color displacement amounts in the first optical head group 123*a*, conditions for formation of electrostatic latent images by the first optical head group 123*a* so that the position of the first transferred developer image and the positions of the second transferred developer images approach (preferably, coincide with) each other. Specifically, the controller 81 sets light emission times and light emission positions in the main scanning direction D2 of the multiple first optical heads in the first optical head group 123*a*. Thereby, the controller 81 corrects color displacement (or displacement) in the traveling direction D1 and main scanning direction D2. However, the controller 81 may set one of the light emission times and light emission positions. The controller 81 may correct color displacement (or displacement) in one of the traveling direction D1 and main scanning direction D2.

In step S13, the controller 81 sets, based on the second color displacement amounts in the second optical head group 123*b*, conditions for formation of electrostatic latent images by the second optical head group 123*b* so that the position of the third transferred developer image and the positions of the fourth transferred developer images approach (preferably, coincide with) each other. Specifically, the controller 81 sets light emission times and light emission positions in the main scanning direction D2 of the multiple second optical heads in the second optical head group 123*b*. Thereby, the controller 81 corrects color displacement (or displacement) in the traveling direction D1 and main scanning direction D2. However, the controller 81 may set one of the light emission times and light emission positions. The controller 81 may correct color displacement (or displacement) in one of the traveling direction D1 and main scanning direction D2.

In step S14, the controller 81 sets, based on the third color displacement amounts in the third optical head group 123*c*, conditions for formation of electrostatic latent images by the third optical head group 123*c* so that the position of the seventh transferred developer image and the positions of the eighth transferred developer images approach (preferably, coincide with) each other. Specifically, the controller 81 sets light emission times and light emission positions in the main scanning direction D2 of the multiple third optical heads in the third optical head group 123*c*. Thereby, the controller 81 corrects color displacement (or displacement) in the traveling direction D1 and main scanning direction D2. However, the controller 81 may set one of the light emission times and light emission positions. The controller 81 may correct color displacement (or displacement) in one of the traveling direction D1 and main scanning direction D2.

In step S15, the controller 81 acquires, based on the detection by the second optical sensor 128*b*, a first joint displacement amount that is a displacement amount between an end portion of a fifth transferred developer image and an end portion of a sixth transferred developer image. The fifth transferred developer image is a transferred developer image corresponding to an electrostatic latent image formed by one of the multiple first optical heads in the first optical head group 123*a*. The sixth transferred developer image is a transferred developer image corresponding to an electrostatic latent image formed by one of the multiple second optical heads in the second optical head group 123*b*. Specifically, the first joint displacement amount includes a displacement amount (or component) Δvj1 in the traveling direction D1 and a displacement amount (or component) Δhj1 in the main scanning direction D2 between the end portion of the fifth transferred developer image and the end portion of the sixth transferred developer image. The controller 81 acquires the displacement amounts Δvj1 and Δhj1.

However, the controller 81 may acquire one of the displacement amounts Δvj1 and Δhj1.

Moreover, the controller 81 acquires, based on the detection by the third optical sensor 128*c*, a second joint displacement amount that is a displacement amount between an end portion of a ninth transferred developer image and an end portion of a tenth transferred developer image. The ninth transferred developer image is a transferred developer image corresponding to an electrostatic latent image formed by one of the multiple second optical heads in the second optical head group 123*b*. The tenth transferred developer image is a transferred developer image corresponding to an electrostatic latent image formed by one of the multiple third optical heads in the third optical head group 123*c*. Specifically, the second joint displacement amount includes a displacement amount (or component) Δvj2 in the traveling direction D1 and a displacement amount (or component) Δhj2 in the main scanning direction D2 between the end portion of the ninth transferred developer image and the end portion of the tenth transferred developer image. The controller 81 acquires the displacement amounts Δvj2 and Δhj2. However, the controller 81 may acquire one of the displacement amounts Δvj2 and Δhj2.

In step S16, the controller 81 sets, based on the first joint displacement amount, conditions for formation of electrostatic latent images by the first optical head group 123*a* and conditions for formation of electrostatic latent images by the second optical head group 123*b* so that the end portion of the fifth transferred developer image and the end portion of the sixth transferred developer image approach (preferably, coincide with) each other or so that the images are correctly aligned. Specifically, the controller 81 sets light emission times and light emission positions in the main scanning direction D2 of the multiple first optical heads in the first optical head group 123*a* and the multiple second optical heads in the second optical head group 123*b*. Thereby, the controller 81 corrects joint displacement (or displacement) in the traveling direction D1 and main scanning direction D2. However, the controller 81 may set one of the light emission times and light emission positions. The controller 81 may correct joint displacement (or displacement) in one of the traveling direction D1 and main scanning direction D2.

In step S17, the controller 81 sets, based on the second joint displacement amount, conditions for formation of electrostatic latent images by the second optical head group 123*b* and conditions for formation of electrostatic latent images by the third optical head group 123*c* so that the end portion of the ninth transferred developer image and the end portion of the tenth transferred developer image approach (preferably, coincide with) each other or so that the images are correctly aligned. Specifically, the controller 81 sets light emission times and light emission positions in the main scanning direction D2 of the multiple second optical heads in the second optical head group 123*b* and the multiple third optical heads in the third optical head group 123*c*. Thereby, the controller 81 corrects joint displacement (or displacement) in the traveling direction D1 and main scanning direction D2. However, the controller 81 may set one of the light emission times and light emission positions. The controller 81 may correct joint displacement (or displacement) in one of the traveling direction D1 and main scanning direction D2.

The order of steps S11 to S17 in FIG. 11 is not limited to the example of FIG. 11. For example, the process may be performed in the order of steps S11, S15, S12, S13, S14, S16, and S17. Moreover, the processes of steps S12, S13, and S14 can be performed in parallel. The processes of steps S16 and S17 can also be performed in parallel.

Figure 12:
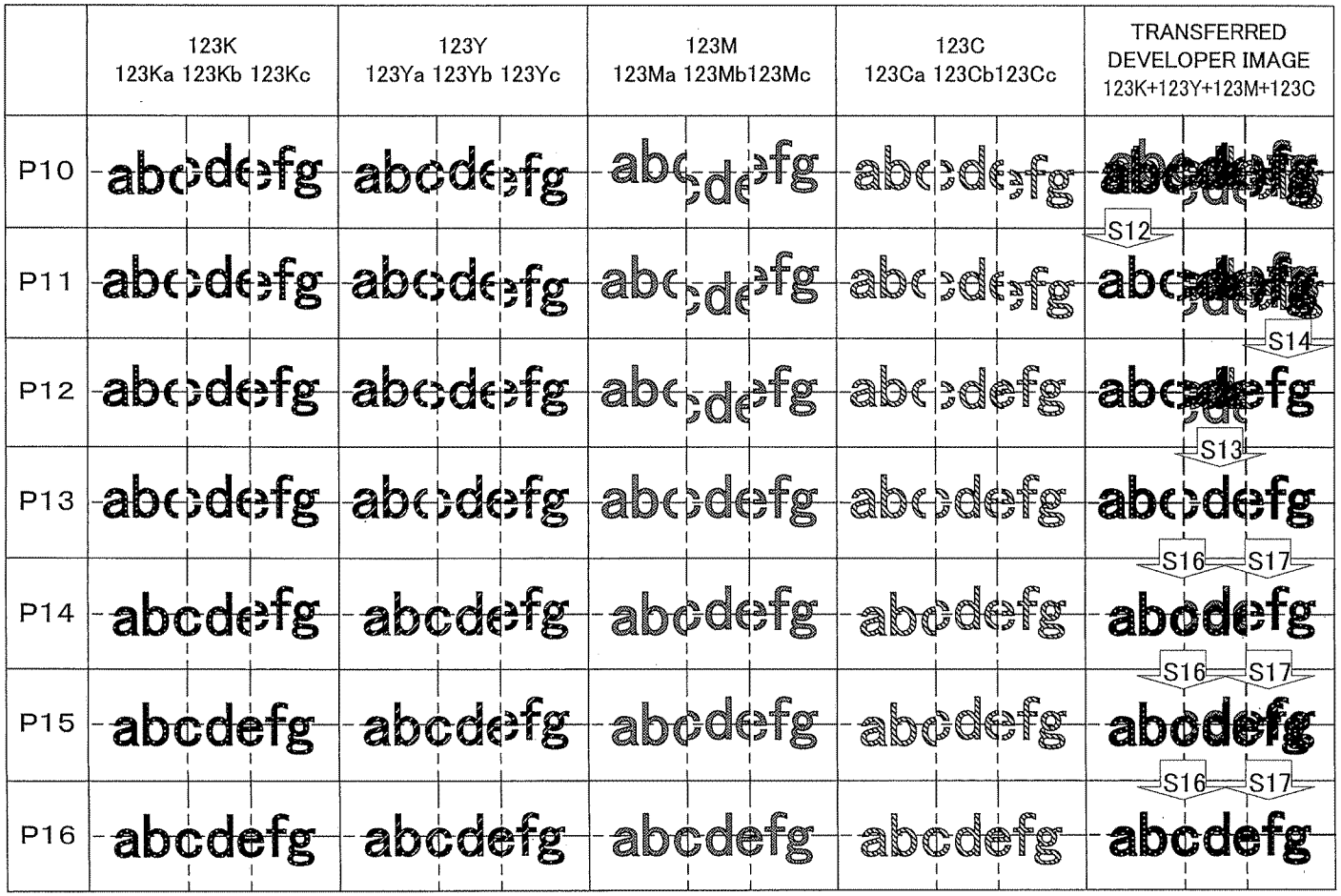
FIG. 12 is an explanatory diagram illustrating a relationship between the image displacement correction process and transferred developer images in the image forming apparatus according to the second embodiment.

FIG. 12 is an explanatory diagram illustrating the image displacement correction process in the image forming apparatus according to the second embodiment. FIG. 12 illustrates how displacement of transferred developer images is corrected by the process illustrated in FIG. 11.

Images P10 illustrated in FIG. 12 are an example of images formed before the image displacement correction process is started (before step S11 in FIG. 11). In each of the transferred developer images "abcdefg", the left character string "abc" is a transferred developer image corresponding to an electrostatic latent image formed by the first optical head in the first optical head group 123*a;* the center character string "cde" is a transferred developer image corresponding to an electrostatic latent image formed by the second optical head in the second optical head group 123*b;* the right character string "efg" is a transferred developer image corresponding to an electrostatic latent image formed by the third optical head in the third optical head group 123*c*. For each of the head units, the character "c" in the character string "abcdefg" is divided into two.

In the transferred developer images P10 illustrated in FIG. 12, the positions of the transferred developer images "abcdefg" formed by the four image forming units 120K, 120Y, 120M, and 120C are displaced from each other. This is because conditions, such as times and positions, for forming electrostatic latent images have not been adjusted in the first optical head group 123*a,* second optical head group 123*b,* and third optical head group 123*c*. Moreover, in the images P10, in each of the character strings "abcdefg", the characters "c" and "e" are each separated into two parts, and joint displacement occurs. This is because the positions at which electrostatic latent images are formed have not been adjusted between the first optical head 123Ka, the second optical head 123Kb, and the third optical head 123Kc in the head unit 123K. The same applies to the other head units 123Y, 123M, and 123C.

Images P11 in FIG. 12 illustrate a state after completion of step S12 in FIG. 11. Images P13 in FIG. 12 illustrate a state after completion of steps S14 and S13 in FIG. 11. Images P14 in FIG. 12 illustrate a state in the middle of steps S16 and S17 in FIG. 11, and images P16 in FIG. 12 illustrate a state after completion of steps S16 and S17 in FIG. 11.

<2-3> Advantages of Second Embodiment

As described above, in the image displacement correction process of the image forming apparatus according to the second embodiment, detection pattern images need to be formed when the color displacements of detection pattern images formed by the first optical heads in the first optical head group 123*a* are acquired, the color displacements of detection pattern images formed by the second optical heads in the second optical head group 123*b* are acquired, and the color displacements of detection pattern images formed by the third optical heads in the third optical head group 123*c* are acquired (step S11), and when the joint displacement between detection pattern images formed by one of the first optical heads in the first optical head group 123*a* and one of the second optical heads in the second optical head group 123*b* is acquired, and the joint displacement between detection pattern images formed by one of the second optical heads in the second optical head group 123*b* and one of the third optical heads in the third optical head group 123*c* is acquired (step S15). In step S15 of the second embodiment, it is sufficient to acquire the joint displacement (Δvj1, Δhj1) between a detection pattern image formed by one of the first optical heads in the first optical head group 123*a* and a detection pattern image formed by one of the second optical heads in the second optical head group 123*b* and acquire the joint displacement (Δvj2, Δhj2) between a detection pattern image formed by one of the second optical heads in the second optical head group 123*b* and a detection pattern image formed by one of the third optical heads in the third optical head group 123*c*. Thus, it is possible to reduce the time required for the image displacement correction process, as compared with a method of acquiring a joint displacement between detection pattern images for each combination of one of the multiple first optical heads in the first optical head group and one of the multiple second optical heads in the second optical head group and for each combination of one of the multiple second optical heads in the second optical head group and one of the multiple third optical heads in the third optical head group. Moreover, in the comparative method, as the number of optical head groups increases, the number of combinations of optical heads increases, and the time required for the image displacement correction process increases. However, according to the image forming apparatus and the image displacement correction method of the second embodiment, the time required for the image displacement correction process can be reduced even if the number of optical head groups increases.

Third Embodiment

<3-1> Configuration of Third Embodiment

An image forming apparatus according to a third embodiment will be described below. In the above first embodiment, color displacement in each of the first and second optical head groups 23*a* and 23*b* is corrected (steps S1 to S3 in FIG. 4), and then a joint displacement amount between one of the optical heads in the first optical head group and one of the optical heads in the second optical head group is acquired and joint displacement is corrected (steps S4 and S5 in FIG. 4). In the third embodiment, in each of multiple head units, a joint displacement amount is acquired and joint displacement is corrected, and then color displacement amounts between the multiple head units are acquired and color displacement is corrected. Except for this, the image forming apparatus according to the third embodiment is the same as the image forming apparatus 1 according to the first embodiment. Thus, the image forming apparatus according to the third embodiment will be described with reference to FIGS. 1 and 2.

The image forming apparatus according to the third embodiment includes the multiple optical head units 23K, 23Y, 23M, and 23C that form electrostatic latent images on the photosensitive drums 21K, 21Y, 21M, and 21C as image carriers. One of the optical head units 23K, 23Y, 23M, and 23C is a first optical head unit, and another is a second optical head unit. For example, the optical head unit 23K is the first optical head unit, and one of the optical head units 23Y, 23M, and 23C is the second optical head unit. The first optical head unit includes multiple optical heads arranged in the main scanning direction and overlapping each other in the main scanning direction. The second optical head unit includes multiple optical heads arranged in the main scanning direction and overlapping each other in the main scanning direction. The image forming apparatus according to the third embodiment includes the detector 28 that is disposed to correspond to a region where the optical heads overlap each other and that detects a displacement amount of each of the heads, and the controller 81 that performs registration by controlling light emission of the multiple optical heads 23Ka, 23Ya, 23Ma, 23Ca, 23Kb, 23Yb, 23Mb, and 23Cb based on the detection by the detector 28. In the registration, with one of the optical heads in the first optical head unit as a reference, the controller 81 performs registration on the other optical heads in the first optical head unit based on the detection by the detector 28; with one of the optical heads in the second optical head unit as a reference, the controller 81 performs registration on the other optical heads in the second optical head unit based on the detection by the detector 28; the controller 81 performs registration between the first optical head unit and the second optical head unit based on a displacement amount between one of the optical heads in the first optical head unit and one of the optical heads in the second optical head units.

Figure 13:
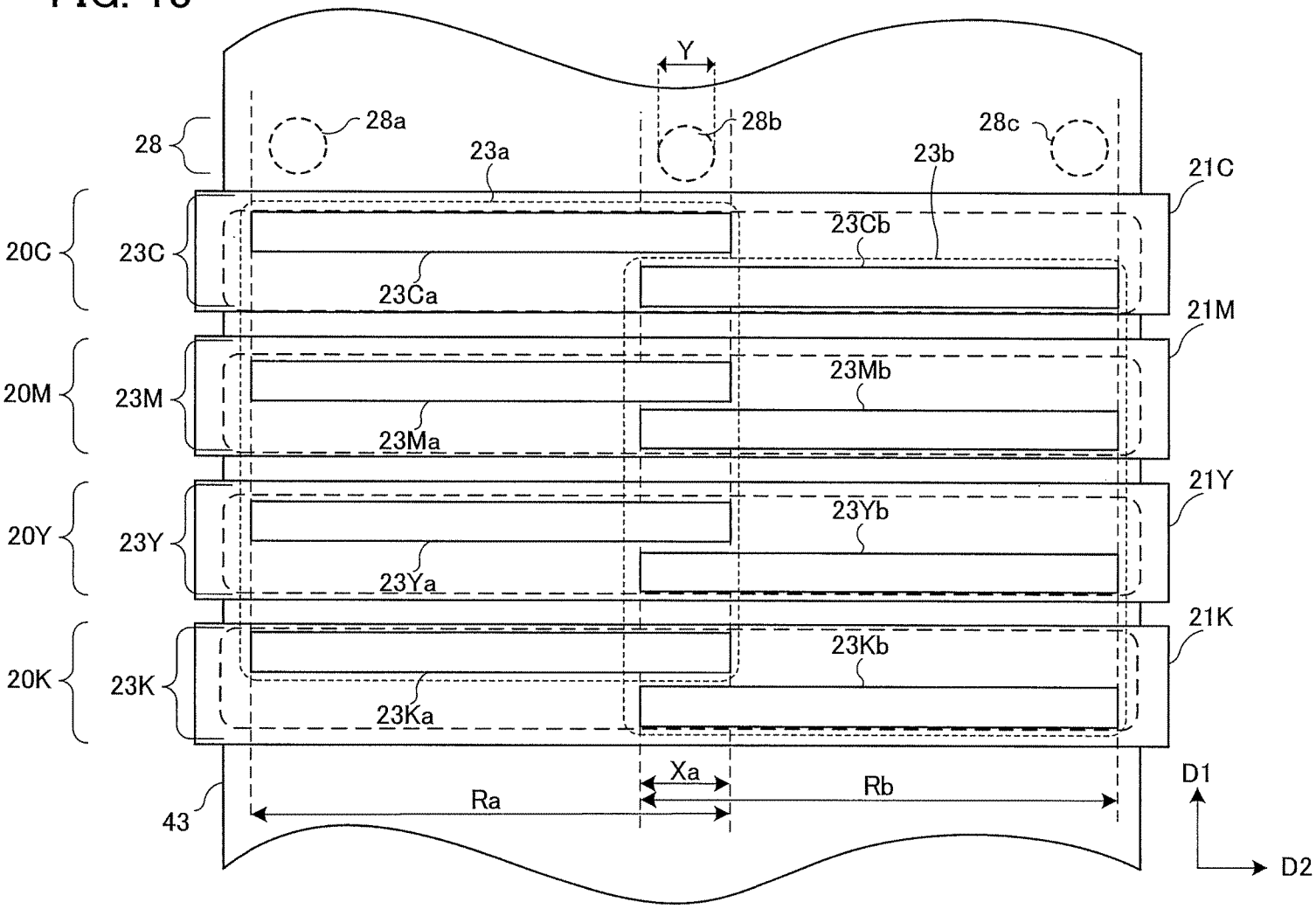
FIG. 13 is a plan view schematically illustrating an arrangement of multiple image forming units, a conveyance belt, and optical sensors in an image forming apparatus according to a third embodiment.

FIG. 13 is a plan view schematically illustrating an arrangement of the multiple image forming units 20K, 20Y, 20M, and 20C, the conveyance belt 43, and the optical sensors 28*a*, 28*b*, and 28*c* constituting the detector 28 in the image forming apparatus according to the third embodiment. In FIG. 13, elements that are the same or correspond to those illustrated in FIG. 3 have the same reference characters.

<3-2> Operation of Third Embodiment

Figure 14:
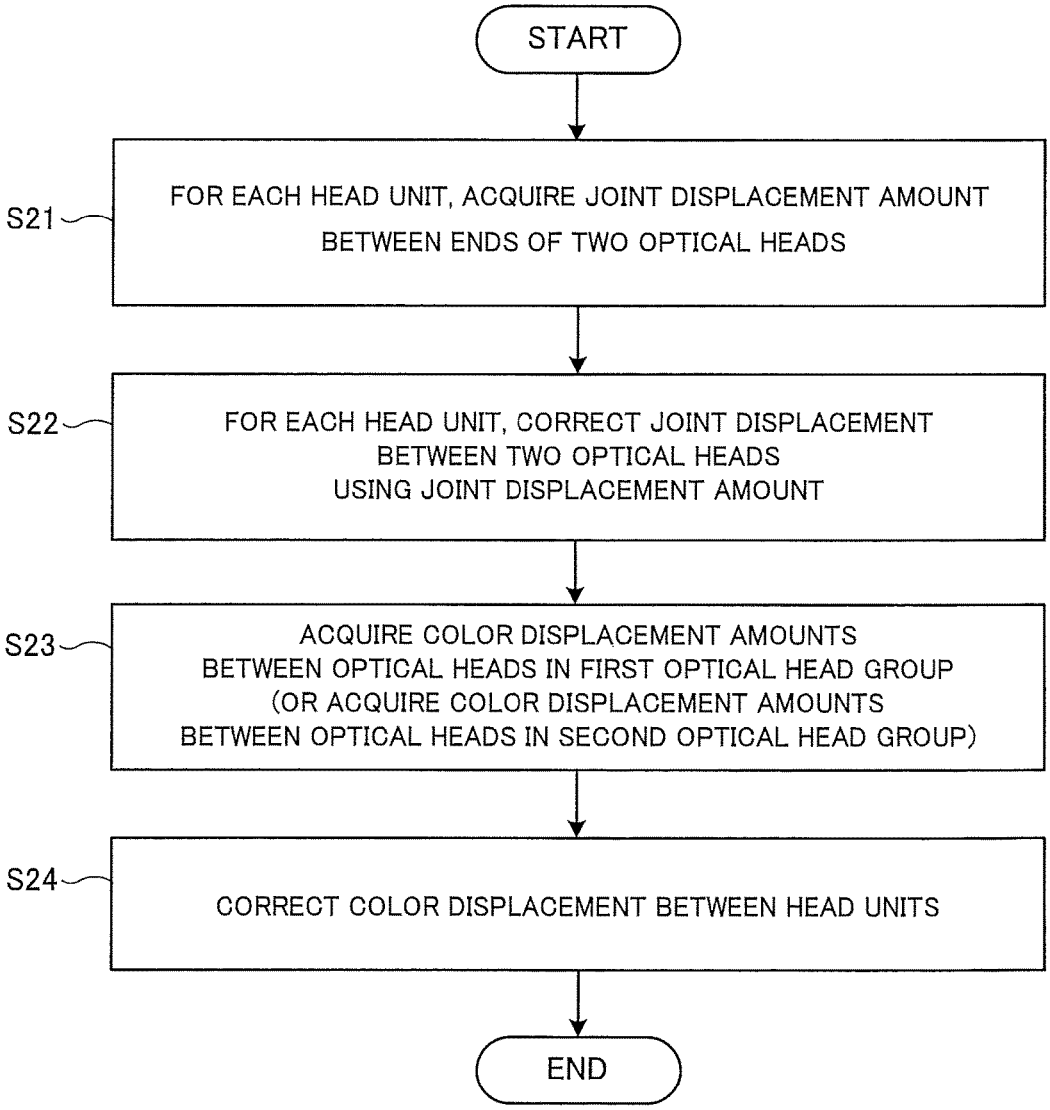
FIG. 14 is a flowchart illustrating an example of an image displacement correction process in the image forming apparatus according to the third embodiment.

FIG. 14 is a flowchart illustrating an example of the image displacement correction process in the image forming apparatus according to the third embodiment.

As illustrated in FIG. 14, in step S21, for each of the head units 23K, 23Y, 23M, and 23C of the multiple image forming units 20K, 20Y, 20M, and 20C, the controller 81 acquires, based on the detection by the detector 28, a joint displacement amount that is a displacement amount between an end portion of a first transferred developer image and an end portion of a second transferred developer image. The first transferred developer image is a transferred developer image corresponding to an electrostatic latent image formed by the first optical head 23Ka, 23Ya, 23Ma, or 23Ca. The second transferred developer image is a transferred developer image corresponding to an electrostatic latent image formed by the second optical head 23Kb, 23Yb, 23Mb, or 23Cb. Specifically, the joint displacement amount includes a displacement amount (or component) Δvj in the traveling direction D1 and a displacement amount (or component) Δhj in the main scanning direction D2 between the end portion of the first transferred developer image and the end portion of the second transferred developer image. The controller 81 acquires the displacement amounts Δvj and Δhj. However, the controller 81 may acquire one of the displacement amounts Δvj and Δhj.

In step S22, for each of the head units 23K, 23Y, 23M, and 23C of the multiple image forming units 20K, 20Y, 20M, and 20C, the controller 81 sets, based on the joint displacement amount, conditions for formation of an electrostatic latent image by the first optical head and conditions for formation of an electrostatic latent image by the second optical head so that the end portion of the first transferred developer image and the end portion of the second transferred developer image approach (preferably, coincide with) each other or so that the images are correctly aligned. That is, the controller 81 corrects the joint displacement. Specifically, the controller 81 sets light emission times and light emission positions in the main scanning direction D2 of the first optical head and the second optical head. Thereby, the controller 81 corrects joint displacement (or displacement) in the traveling direction D1 and main scanning direction D2. However, the controller 81 may set one of the light emission times and light emission positions. The controller 81 may correct joint displacement (or displacement) in one of the traveling direction D1 and main scanning direction D2.

In step S23, the controller 81 acquires one or more displacement amounts between a position of a third transferred developer image and positions of one or more fourth transferred developer images. The third transferred developer image is a transferred developer image corresponding to an electrostatic latent image formed by a reference first optical head that is one of the multiple first optical heads in the first optical head group 23*a*. The fourth transferred developer images are transferred developer images corresponding to electrostatic latent images formed by one or more first optical heads other than the reference first optical head in the first optical head group 23*a*. Specifically, each of the one or more displacement amounts includes a displacement amount (or component) Δvc in the traveling direction D1 and a displacement amount (or component) Δhc in the main scanning direction D2 between the third transferred developer image and the fourth transferred developer image. For each of the one or more first optical heads other than the reference first optical head, the controller 81 acquires the displacement amounts Δvc and Δhc. However, the controller 81 may acquire one of the displacement amounts Δvc and Δhc.

Alternatively, the controller 81 may acquire one or more displacement amounts between a position of a fifth transferred developer image and positions of one or more sixth transferred developer images. The fifth transferred developer image is a transferred developer image corresponding to an electrostatic latent image formed by a reference second optical head that is one of the multiple second optical heads in the second optical head group 23*b*. The sixth transferred developer images are transferred developer images corresponding to electrostatic latent images formed by one or more second optical heads other than the reference second optical head in the second optical head group 23*b*. Specifically, each of the one or more displacement amounts includes a displacement amount (or component) Δvc in the traveling direction D1 and a displacement amount (or component) Δhc in the main scanning direction D2 between the fifth transferred developer image and the sixth transferred developer image. For each of the one or more second optical heads other than the reference second optical head, the controller 81 acquires the displacement amounts Δvc and Δhc. However, the controller 81 may acquire one of the displacement amounts Δvc and Δhc.

In step S24, based on the displacement amounts acquired in step S23, the controller 81 performs a process of setting conditions for formation of electrostatic latent images by the first optical head group 23*a* so that the position of the third transferred developer image and the positions of the fourth transferred developer images approach (preferably, coincide with) each other. Specifically, the controller 81 sets light emission times and light emission positions in the main scanning direction D2 of the multiple first optical heads in the first optical head group 23*a*. Thereby, the controller 81 corrects color displacement (or displacement) in the traveling direction D1 and main scanning direction D2. However, the controller 81 may set one of the light emission times and light emission positions. The controller 81 may correct color displacement (or displacement) in one of the traveling direction D1 and main scanning direction D2.

Moreover, in step S24, based on the displacement amounts acquired in step S23, the controller 81 performs a process of setting conditions for formation of electrostatic latent images by the second optical head group 23*b* so that the position of the fifth transferred developer image and the positions of the sixth transferred developer images approach (preferably, coincide with) each other. Specifically, the controller 81 sets light emission times and light emission positions in the main scanning direction D2 of the multiple second optical heads in the second optical head group 23*b*. Thereby, the controller 81 corrects color displacement (or displacement) in the traveling direction D1 and main scanning direction D2. However, the controller 81 may set one of the light emission times and light emission positions. The controller 81 may correct color displacement (or displacement) in one of the traveling direction D1 and main scanning direction D2.

Figure 15:
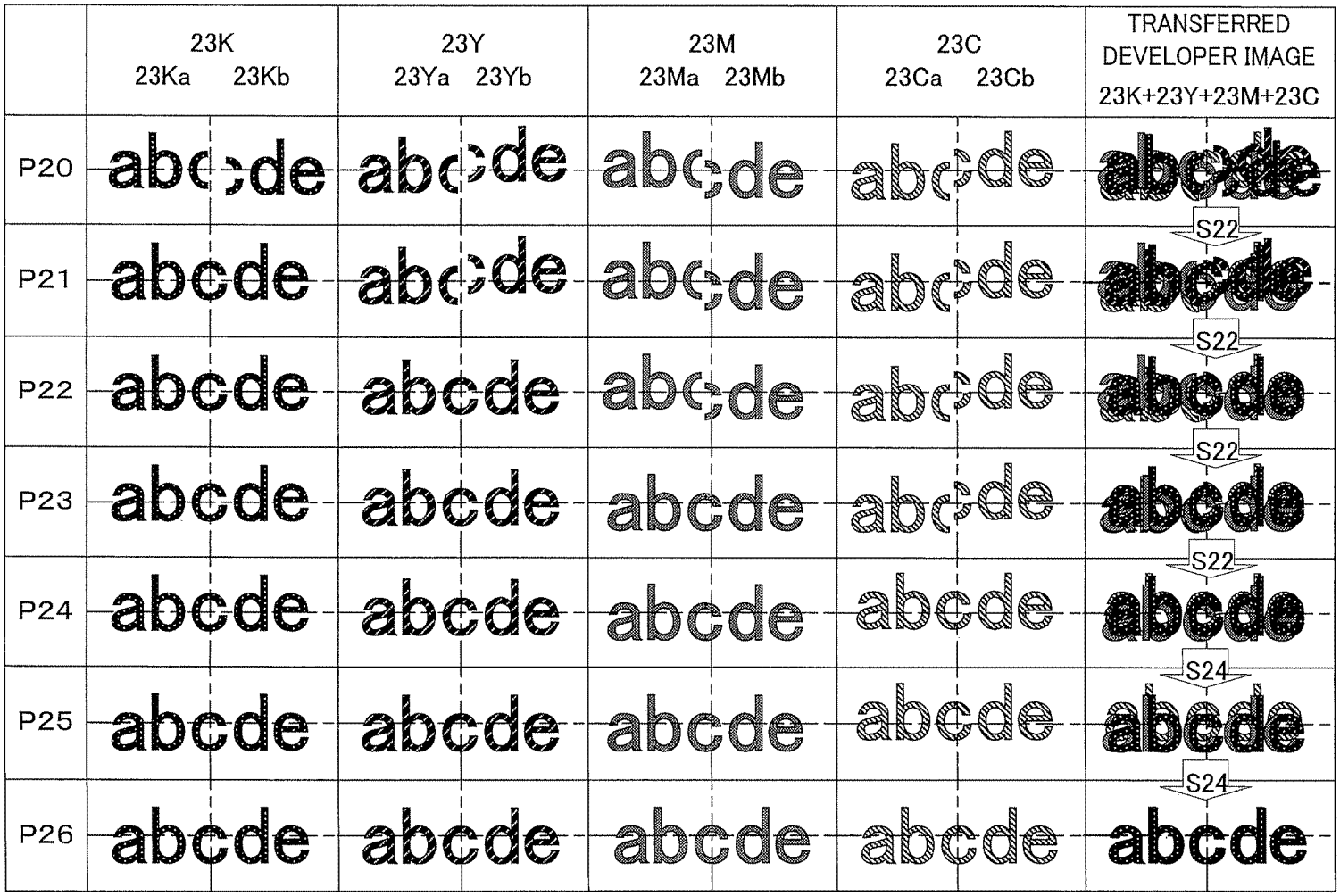
FIG. 15 is an explanatory diagram illustrating a relationship between the image displacement correction process and transferred developer images in the image forming apparatus according to the third embodiment.

FIG. 15 is an explanatory diagram illustrating a relationship between the image displacement correction process and transferred developer images in the image forming apparatus according to the third embodiment. FIG. 15 illustrates how displacement of transferred developer images is corrected by the process illustrated in FIG. 14.

Images P20 illustrated in FIG. 15 are an example of images formed before the image displacement correction process is started (before step S21 in FIG. 14). In each of the transferred developer images "abode", the left character string "abc" is a transferred developer image corresponding to an electrostatic latent image formed by the first optical head in the first optical head group 23*a*, and the right character string "cde" is a transferred developer image corresponding to an electrostatic latent image formed by the second optical head in the second optical head group 23*b*. In each of the head units, the character "c" in the character string "abcde" is divided into two.

In the transferred developer images P20 illustrated in FIG. 15, the positions of the transferred developer images "abcde" formed by the four image forming units 20K, 20Y, 20M, and 20C are displaced from each other. This is because conditions, such as times and positions, for forming electrostatic latent images have not been adjusted in the first optical head group 23*a* and the second optical head group 23*b*. Moreover, in the images P20, in each of the character strings "abcde", the character "c" is separated into two parts, and joint displacement occurs. This is because the positions at which electrostatic latent images are formed have not been adjusted between the first optical head 23Ka and the second optical head 23Kb in the head unit 23K. The same applies to the other head units 23Y, 23M, and 23C.

Images P21 in FIG. 15 illustrate a state in the middle of step S22 in FIG. 14. Images P22 in FIG. 15 illustrate a state in the middle of step S22 in FIG. 14. Images P23 in FIG. 15 illustrate a state in the middle of step S22 in FIG. 14. Images P24 in FIG. 15 illustrate a state in which step S22 in FIG. 14 has been completed. Images P25 in FIG. 15 illustrate a state in the middle of step S24 in FIG. 14. Images P26 in FIG. 15 illustrate a state in which step S24 in FIG. 14 has been completed.

<3-3> Advantages of Third Embodiment

As described above, in the image displacement correction process of the image forming apparatus according to the third embodiment, detection pattern images need to be formed when the joint displacement between the optical heads is acquired for each of the head units (step S21), and when the color displacements between the detection pattern images formed by the first optical heads in the first optical head group 23*a* (or the color displacements between the detection pattern images formed by the second optical heads in the second optical head group 23*b*) are acquired (step S23). Thus, it is possible to reduce the time required for the image displacement correction process, as compared with a method of acquiring a displacement (joint displacement) between detection pattern images for each combination of one of the multiple first optical heads in the first optical head group 23*a* and one of the multiple second optical heads in the second optical head group 23*b*.

In this specification, the term "displacement" may be replaced with the term "misalignment" or "misregistration".

The present invention is not limited to the embodiments described above; it can be practiced in various other aspects without departing from the invention scope.

What is claimed is:

1. An image forming apparatus comprising:

a first optical head group and a second optical head group that form electrostatic latent images on at least one image carrier, the first optical head group including a plurality of first optical heads arranged in a sub-scanning direction, the second optical head group including a plurality of second optical heads arranged in the sub-scanning direction, the first optical head group and the second optical head group overlapping each other in a main scanning direction;

a detector that is disposed to correspond to a region where the first optical head group and the second optical head group overlap each other and that detects displacement amounts between the first optical heads and the second optical heads; and a controller that performs registration by controlling light emission of the plurality of first optical heads and the plurality of second optical heads based on the detection by the detector, wherein the controller:

with one of the first optical heads in the first optical head group as a reference, performs registration on the other first optical heads in the first optical head group based on the detection by the detector;

with one of the second optical heads in the second optical head group as a reference, performs registration on the other second optical heads in the second optical head group based on the detection by the detector; and performs registration between the first optical head group and the second optical head group based on a displacement amount between one of the first optical heads in the first optical head group and one of the second optical heads in the second optical head group.

2. The image forming apparatus of claim 1, further comprising:

a belt supported movably in a traveling direction; and a plurality of image forming units arranged in the traveling direction of the belt, each of the plurality of image forming units including:

an image carrier;

a head unit including a first optical head that forms an electrostatic latent image on the image carrier in a first region in the main scanning direction and a second optical head that forms an electrostatic latent image on the image carrier in a second region in the main scanning direction; and a developing unit that forms developer images corresponding to the electrostatic latent images, wherein the detector detects transferred developer images that are developer images transferred on the belt from the plurality of image forming units, wherein the controller controls operation of the plurality of image forming units, wherein the image carriers in the plurality of image forming units are the at least one image carrier, wherein the first optical heads in the plurality of image forming units are the plurality of first optical heads in the first optical head group, wherein the second optical heads in the plurality of image forming units are the plurality of second optical heads in the second optical head group, wherein in the registration, the controller:

acquires, based on the detection, one or more first displacement amounts between a position in the traveling direction of a first transferred developer image and positions in the traveling direction of one or more second transferred developer images, the first transferred developer image being a transferred developer image corresponding to an electrostatic latent image formed by a reference first optical head that is one of the plurality of first optical heads in the first optical head group, the second transferred developer images being transferred developer images corresponding to electrostatic latent images formed by one or more first optical heads other than the reference first optical head in the first optical head group;

acquires, based on the detection, one or more second displacement amounts between a position in the traveling direction of a third transferred developer image and positions in the traveling direction of one or more fourth transferred developer images, the third transferred developer image being a transferred developer image corresponding to an electrostatic latent image formed by a reference second optical head that is one of the plurality of second optical heads in the second optical head group, the fourth transferred developer images being transferred developer images corresponding to electrostatic latent images formed by one or more second optical heads other than the reference second optical head in the second optical head group;

acquires, based on the detection, a first joint displacement amount including a displacement amount in the traveling direction and a displacement amount in the main scanning direction between an end portion of a fifth transferred developer image and an end portion of a sixth transferred developer image, the fifth transferred developer image being a transferred developer image corresponding to an electrostatic latent image formed by one of the plurality of first optical heads in the first optical head group, the sixth transferred developer image being a transferred developer image corresponding to an electrostatic latent image formed by one of the plurality of second optical heads in the second optical head group;

sets, based on the first displacement amounts, conditions for formation of the electrostatic latent images by the first optical head group so that the position in the traveling direction of the first transferred developer image and the positions in the traveling direction of the second transferred developer images approach each other;

sets, based on the second displacement amounts, conditions for formation of the electrostatic latent images by the second optical head group so that the position in the traveling direction of the third transferred developer image and the positions in the traveling direction of the fourth transferred developer images approach each other; and sets, based on the first joint displacement amount, conditions for formation of the electrostatic latent images by the first optical head group and conditions for formation of the electrostatic latent images by the second optical head group so that the end portion of the fifth transferred developer image and the end portion of the sixth transferred developer image approach each other.

3. The image forming apparatus of claim 2, wherein in each of the plurality of image forming units, the first optical head and the second optical head are disposed at different positions in the sub-scanning direction perpendicular to the main scanning direction, and an end portion of the first optical head and a first end portion of the second optical head form a first overlap portion where the end portion of the first optical head and the first end portion of the second optical head overlap each other in the main scanning direction.

4. The image forming apparatus of claim 3, wherein the detector includes:

a first optical sensor that detects positions of the first and second transferred developer images;

a second optical sensor that detects positions of the first to sixth transferred developer images in a region corresponding to the first overlap portion; and a third optical sensor that detects positions of the third and fourth transferred developer images.

5. The image forming apparatus of claim 4, wherein each of the head units of the plurality of image forming units further includes a third optical head that forms an electrostatic latent image on the image carrier in a third region in the main scanning direction, wherein the third optical heads in the plurality of image forming units constitute a third optical head group, and wherein the controller:

acquires, based on the detection, one or more third displacement amounts between a position in the traveling direction of a seventh transferred developer image and positions in the traveling direction of one or more eighth transferred developer images, the seventh transferred developer image being a transferred developer image corresponding to an electrostatic latent image formed by a reference third optical head that is one of the plurality of third optical heads in the third optical head group, the eighth transferred developer images being transferred developer images corresponding to electrostatic latent images formed by one or more third optical heads other than the reference third optical head in the third optical head group;

acquires, based on the detection, a second joint displacement amount including a displacement amount in the traveling direction and a displacement amount in the main scanning direction between an end portion of a ninth transferred developer image and an end portion of a tenth transferred developer image, the ninth transferred developer image being a transferred developer image corresponding to an electrostatic latent image formed by one of the plurality of second optical heads in the second optical head group, the tenth transferred developer image being a transferred developer image corresponding to an electrostatic latent image formed by one of the plurality of third optical heads in the third optical head group;

sets, based on the third displacement amounts, conditions for formation of the electrostatic latent images by the third optical head group so that the position in the traveling direction of the seventh transferred developer image and the positions in the traveling direction of the eighth transferred developer images approach each other; and sets, based on the second joint displacement amount, conditions for formation of the electrostatic latent images by the second optical head group and conditions for formation of the electrostatic latent images by the third optical head group so that the end portion of the ninth transferred developer image and the end portion of the tenth transferred developer image approach each other.

6. The image forming apparatus of claim 5, wherein in each of the plurality of image forming units, the second optical head and the third optical head are disposed at different positions in the sub-scanning direction, and a second end portion of the second optical head and an end portion of the third optical head form a second overlap portion where the second end portion of the second optical head and the end portion of the third optical head overlap each other in the main scanning direction.

7. The image forming apparatus of claim 6, wherein the detector further includes a fourth optical sensor that detects positions in the traveling direction of the seventh and eighth transferred developer images, and wherein the third optical sensor detects positions in the traveling direction of the third, fourth, and seventh to tenth transferred developer images in a region corresponding to the second overlap portion.

8. An image forming apparatus comprising:

a first optical head unit and a second optical head unit that form electrostatic latent images on at least one image carrier, the first optical head unit including a plurality of optical heads arranged in a main scanning direction to overlap each other in the main scanning direction, the second optical head unit including a plurality of optical heads arranged in the main scanning direction to overlap each other in the main scanning direction;

a detector that is disposed to correspond to a region where the optical heads overlap each other and that detects a displacement amount of each of the optical heads; and a controller that performs registration by controlling light emission of the optical heads based on the detection by the detector, wherein, in the registration, the controller:

with one of the plurality of optical heads in the first optical head unit as a reference, performs registration on the other optical heads in the first optical head unit based on the detection by the detector;

with one of the plurality of optical heads in the second optical head unit as a reference, performs registration on the other optical heads in the second optical head unit based on the detection by the detector; and performs registration between the first optical head unit and the second optical head unit based on a displacement amount between one of the plurality of optical heads in the first optical head unit and one of the plurality of optical heads in the second optical head unit.

9. The image forming apparatus of claim 8, further comprising:

a belt supported movably in a traveling direction; and a plurality of image forming units arranged in the traveling direction of the belt, each of the plurality of image forming units including:

an image carrier;

a head unit including a first optical head that is an optical head that forms an electrostatic latent image on the image carrier in a first region in the main scanning direction and a second optical head that is an optical head that forms an electrostatic latent image on the image carrier in a second region in the main scanning direction; and a developing unit that forms developer images corresponding to the electrostatic latent images, wherein the detector detects transferred developer images that are developer images transferred on the belt from the plurality of image forming units, wherein the controller controls operation of the plurality of image forming units, wherein the image carriers in the plurality of image forming units are the at least one image carrier, wherein the head units of two of the plurality of image forming units are the first and second optical head units, wherein the first optical heads in the plurality of image forming units constitute a first optical head group, wherein the second optical heads in the plurality of image forming units constitute a second optical head group, wherein in each of the plurality of image forming units, an end portion of the first optical head and an end portion of the second optical head form a first overlap portion where the end portion of the first optical head and the end portion of the second optical head overlap each other in the main scanning direction, and wherein the controller:

for each of the head units of the plurality of image forming units, based on the detection, acquires a joint displacement amount including a displacement amount in the traveling direction and a displacement amount in the main scanning direction between an end portion of a first transferred developer image and an end portion of a second transferred developer image, the first transferred developer image being a transferred developer image corresponding to an electrostatic latent image formed by the first optical head, the second transferred developer image being a transferred developer image corresponding to an electrostatic latent image formed by the second optical head;

for each of the head units of the plurality of image forming units, based on the joint displacement amount, sets conditions for formation of the electrostatic latent image by the first optical head and conditions for formation of the electrostatic latent image by the second optical head so that the end portion of the first transferred developer image and the end portion of the second transferred developer image approach each other;

acquires one or more displacement amounts between a position in the traveling direction of a third transferred developer image and positions in the traveling direction of one or more fourth transferred developer images or between a position in the traveling direction of a fifth transferred developer image and positions in the traveling direction of one or more sixth transferred developer images, the third transferred developer image being a transferred developer image corresponding to an electrostatic latent image formed by a reference first optical head that is one of the plurality of first optical heads in the first optical head group, the fourth transferred developer images being transferred developer images corresponding to electrostatic latent images formed by one or more first optical heads other than the reference first optical head in the first optical head group, the fifth transferred developer image being a transferred developer image corresponding to an electrostatic latent image formed by a reference second optical head that is one of the plurality of second optical heads in the second optical head group, the sixth transferred developer images being transferred developer images corresponding to electrostatic latent images formed by one or more second optical heads other than the reference second optical head in the second optical head group; and based on the acquired displacement amounts, performs a process of setting conditions for formation of the electrostatic latent images by the first optical head group so that the position in the traveling direction of the third transferred developer image and the positions in the traveling direction of the fourth transferred developer images approach each other, and a process of setting conditions for formation of the electrostatic latent images by the second optical head group so that the position in the traveling direction of the fifth transferred developer image and the positions in the traveling direction of the sixth transferred developer images approach each other.

10. The image forming apparatus of claim 9, wherein in each of the plurality of image forming units, the first optical head and the second optical head are disposed at different positions in a sub-scanning direction perpendicular to the main scanning direction.

11. The image forming apparatus of claim 9, wherein the detector includes:

a first optical sensor that detects positions of the third and fourth transferred developer images;

a second optical sensor that detects positions of the first and second transferred developer images in a region corresponding to the first overlap portion; and a third optical sensor that detects positions of the fifth and sixth transferred developer images.

12. An image displacement correction method in an image forming apparatus including:

a first optical head group and a second optical head group that form electrostatic latent images on at least one image carrier, the first optical head group including a plurality of first optical heads arranged in a sub-scanning direction, the second optical head group including a plurality of second optical heads arranged in the sub-scanning direction, the first optical head group and the second optical head group overlapping each other in a main scanning direction;

a detector that is disposed to correspond to a region where the first optical head group and the second optical head group overlap each other and that detects displacement amounts between the first optical heads and the second optical heads; and a controller that performs registration by controlling light emission of the plurality of first optical heads and the plurality of second optical heads based on the detection by the detector, the image displacement correction method comprising:

with one of the first optical heads in the first optical head group as a reference, performing registration on the other first optical heads in the first optical head group based on the detection by the detector;

with one of the second optical heads in the second optical head group as a reference, performing registration on the other second optical heads in the second optical head group based on the detection by the detector; and performing registration between the first optical head group and the second optical head group based on a displacement amount between one of the first optical heads in the first optical head group and one of the second optical heads in the second optical head group.

13. An image displacement correction method in an image forming apparatus including:

a belt supported movably in a traveling direction;

a plurality of image forming units arranged in the traveling direction of the belt, each of the plurality of image forming units including:

an image carrier;

a head unit including a first optical head that forms an electrostatic latent image on the image carrier in a first region in the main scanning direction and a second optical head that forms an electrostatic latent image on the image carrier in a second region in the main scanning direction; and a developing unit that forms developer images corresponding to the electrostatic latent images; and a detector that detects transferred developer images that are developer images transferred on the belt from the plurality of image forming units, wherein the first optical heads in the plurality of image forming units constitute a first optical head group, and the second optical heads in the plurality of image forming units constitute a second optical head group, the image displacement correction method comprising:

acquiring, based on the detection, one or more first displacement amounts between a position in the traveling direction of a first transferred developer image and positions in the traveling direction of one or more second transferred developer images, the first transferred developer image being a transferred developer image corresponding to an electrostatic latent image formed by a reference first optical head that is one of the plurality of first optical heads in the first optical head group, the second transferred developer images being transferred developer images corresponding to electrostatic latent images formed by one or more first optical heads other than the reference first optical head in the first optical head group;

acquiring, based on the detection, one or more second displacement amounts between a position in the traveling direction of a third transferred developer image and positions in the traveling direction of one or more fourth transferred developer images, the third transferred developer image being a transferred developer image corresponding to an electrostatic latent image formed by a reference second optical head that is one of the plurality of second optical heads in the second optical head group, the fourth transferred developer images being transferred developer images corresponding to electrostatic latent images formed by one or more second optical heads other than the reference second optical head in the second optical head group;

acquiring, based on the detection, a first joint displacement amount including a displacement amount in the traveling direction and a displacement amount in the main scanning direction between an end portion of a fifth transferred developer image and an end portion of a sixth transferred developer image, the fifth transferred developer image being a transferred developer image corresponding to an electrostatic latent image formed by one of the plurality of first optical heads in the first optical head group, the sixth transferred developer image being a transferred developer image corresponding to an electrostatic latent image formed by one of the plurality of second optical heads in the second optical head group;

setting, based on the first displacement amounts, conditions for formation of the electrostatic latent images by the first optical head group so that the position in the traveling direction of the first transferred developer image and the positions in the traveling direction of the second transferred developer images approach each other;

setting, based on the second displacement amounts, conditions for formation of the electrostatic latent images by the second optical head group so that the position in the traveling direction of the third transferred developer image and the positions in the traveling direction of the fourth transferred developer images approach each other; and setting, based on the first joint displacement amount, conditions for formation of the electrostatic latent images by the first optical head group and conditions for formation of the electrostatic latent images by the second optical head group so that the end portion of the fifth transferred developer image and the end portion of the sixth transferred developer image approach each other.

14. An image displacement correction method in an image forming apparatus including:

a first optical head unit and a second optical head unit that form electrostatic latent images on at least one image carrier, the first optical head unit including a plurality of optical heads arranged in a main scanning direction to overlap each other in the main scanning direction, the second optical head unit including a plurality of optical heads arranged in the main scanning direction to overlap each other in the main scanning direction;

a detector that is disposed to correspond to a region where the optical heads overlap each other and that detects a displacement amount of each of the optical heads; and a controller that performs registration by controlling light emission of the optical heads based on the detection by the detector, the image displacement correction method comprising:

with one of the plurality of optical heads in the first optical head unit as a reference, performing registration on the other optical heads in the first optical head unit based on the detection by the detector;

with one of the plurality of optical heads in the second optical head unit as a reference, performing registration on the other optical heads in the second optical head unit based on the detection by the detector; and performing registration between the first optical head unit and the second optical head unit based on a displacement amount between one of the plurality of optical heads in the first optical head unit and one of the plurality of optical heads in the second optical head unit.

15. An image displacement correction method in an image forming apparatus including:

a belt supported movably in a traveling direction;

a plurality of image forming units arranged in the traveling direction of the belt, each of the plurality of image forming units including:

an image carrier;

a head unit including a first optical head that forms an electrostatic latent image on the image carrier in a first region in the main scanning direction and a second optical head that forms an electrostatic latent image on the image carrier in a second region in the main scanning direction; and a developing unit that forms developer images corresponding to the electrostatic latent images; and a detector that detects transferred developer images that are developer images transferred on the belt from the plurality of image forming units, wherein the first optical heads in the plurality of image forming units constitute a first optical head group, and the second optical heads in the plurality of image forming units constitute a second optical head group, the image displacement correction method comprising:

for each of the head units of the plurality of image forming units, based on the detection, acquiring a joint displacement amount including a displacement amount in the traveling direction and a displacement amount in the main scanning direction between an end portion of a first transferred developer image and an end portion of a second transferred developer image, the first transferred developer image being a transferred developer image corresponding to an electrostatic latent image formed by the first optical head, the second transferred developer image being a transferred developer image corresponding to an electrostatic latent image formed by the second optical head;

for each of the head units of the plurality of image forming units, based on the joint displacement amount, setting conditions for formation of the electrostatic latent image by the first optical head and conditions for formation of the electrostatic latent image by the second optical head so that the end portion of the first transferred developer image and the end portion of the second transferred developer image approach each other;

acquiring one or more displacement amounts between a position in the traveling direction of a third transferred developer image and positions in the traveling direction of one or more fourth transferred developer images or between a position in the traveling direction of a fifth transferred developer image and positions in the traveling direction of one or more sixth transferred developer images, the third transferred developer image being a transferred developer image corresponding to an electrostatic latent image formed by a reference first optical head that is one of the plurality of first optical heads in the first optical head group, the fourth transferred developer images being transferred developer images corresponding to electrostatic latent images formed by one or more first optical heads other than the reference first optical head in the first optical head group, the fifth transferred developer image being a transferred developer image corresponding to an electrostatic latent image formed by a reference second optical head that is one of the plurality of second optical heads in the second optical head group, the sixth transferred developer images being transferred developer images corresponding to electrostatic latent images formed by one or more second optical heads other than the reference second optical head in the second optical head group; and based on the acquired displacement amounts, performing a process of setting conditions for formation of the electrostatic latent images by the first optical head group so that the position in the traveling direction of the third transferred developer image and the positions in the traveling direction of the fourth transferred developer images approach each other, and a process of setting conditions for formation of the electrostatic latent images by the second optical head group so that the position in the traveling direction of the fifth transferred developer image and the positions in the traveling direction of the sixth transferred developer images approach each other.

* * * * *